US011971233B2

(12) United States Patent
Werdnig et al.

(10) Patent No.: US 11,971,233 B2
(45) Date of Patent: Apr. 30, 2024

(54) TRIGGER FOR A FIREARM AND A FIREARM EQUIPPED THEREWITH

(71) Applicant: GLOCK TECHNOLOGY GMBH, Ferlach (AT)

(72) Inventors: Andreas Werdnig, Klagenfurt (AT); Andreas Wutte, Ferlach (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 113 days.

(21) Appl. No.: 17/757,446

(22) PCT Filed: Oct. 13, 2020

(86) PCT No.: PCT/EP2020/078722
§ 371 (c)(1),
(2) Date: Jun. 15, 2022

(87) PCT Pub. No.: WO2021/121708
PCT Pub. Date: Jun. 24, 2021

(65) Prior Publication Data

US 2023/0228511 A1 Jul. 20, 2023

(30) Foreign Application Priority Data

Dec. 17, 2019 (EP) ..... 19216895

(51) Int. Cl.
*F41A 19/16* (2006.01)
*F41A 11/02* (2006.01)
(Continued)

(52) U.S. Cl.
CPC ..... *F41A 19/16* (2013.01); *F41A 11/02* (2013.01); *F41A 19/02* (2013.01); *F41A 19/15* (2013.01); *F41A 19/45* (2013.01)

(58) Field of Classification Search
CPC ..... F41A 11/02; F41A 19/02; F41A 19/10; F41A 19/12; F41A 19/14; F41A 19/15;
(Continued)

(56) References Cited

U.S. PATENT DOCUMENTS 3,292,492 A 12/1966 Sturtevant
4,893,547 A * 1/1990 Atchisson ..... F41A 3/72 89/187.01

(Continued)

FOREIGN PATENT DOCUMENTS

DE 202011004556 U1 7/2012
EP 2950033 A1 12/2015
FR 1530296 A 6/1968

OTHER PUBLICATIONS

International Search Report for PCT/EP2020/078722; established Apr. 19, 2021.

*Primary Examiner* — Joshua E Freeman
*Assistant Examiner* — Benjamin S Gomberg
(74) *Attorney, Agent, or Firm* — Raven Patents, LLC; Anton E. Skaugset

(57) ABSTRACT

A trigger unit for a firearm, including a trigger bar that lies below the trigger axis. A trigger lever has a rear which accommodates at least one disconnector. A sear, rotatable about a sear axis can be biased by means of a sear spring. The hammer axis, the trigger axis and the sear axis are arranged parallel to one another and parallel to a transverse direction. The trigger lever has a recess and the sear is at least partially arranged within. The sear axis and the trigger axis coincide. The sear limits rotation of a disconnector joint formed on the underside of the disconnector; the bearing encloses the disconnector joint at least partially.

18 Claims, 19 Drawing Sheets

(51) Int. Cl.
*F41A 19/02* (2006.01)
*F41A 19/15* (2006.01)
*F41A 19/45* (2006.01)

(58) Field of Classification Search
CPC ..... F41A 19/16; F41A 19/42; F41A 19/43; F41A 19/44; F41A 19/45; F41A 19/46
USPC ..... 42/69.01
See application file for complete search history.

(56) References Cited

U.S. PATENT DOCUMENTS

| | | | | |
|---|---|---|---|---|
| 5,913,261 | A * | 6/1999 | Guhring | F41A 19/15 89/142 |
| 7,600,338 | B2 | 10/2009 | Geissele | |
| 10,330,413 | B2 | 6/2019 | Williams et al. | |
| 10,837,728 | B2 * | 11/2020 | Olson | F41A 19/44 |
| 2009/0188145 | A1 * | 7/2009 | Fluhr | F41A 17/46 42/69.01 |
| 2014/0366418 | A1 * | 12/2014 | Stakes | F41A 19/10 42/69.03 |
| 2015/0153125 | A1 * | 6/2015 | Lutton | F41A 19/10 42/69.01 |
| 2016/0363401 | A1 | 12/2016 | Elftmann | |
| 2017/0138689 | A1 * | 5/2017 | Biegel | F41A 19/14 |
| 2019/0257606 | A1 | 8/2019 | Olson | |
| 2020/0182573 | A1 * | 6/2020 | Elftmann, Jr. | F41A 19/45 |
| 2022/0214126 | A1 * | 7/2022 | Afshari | F41A 19/17 |
| 2022/0325971 | A1 * | 10/2022 | Bray | F41A 19/10 |

* cited by examiner

PRIOR ART

TRIGGER FOR A FIREARM AND A FIREARM EQUIPPED THEREWITH

TECHNICAL FIELD

The disclosure is directed generally to firearms, and more particularly to modular drop-in trigger units configured to be simply pushed into a firearm, preferably into the lower receiver of the firearm.

BACKGROUND

A modern trigger unit should generally be easy to use, reliable, easy to maintain and, by means of a fire-control/safety selector, should be adjustable between a "safe" state and at least one "unlocked" or "fire" state. A large number of such trigger units have a construction which prevents the selector from being adjusted to the "safe" position when the hammer is in the behind or downward position. This is often due to the fact that the trigger lever, which includes a sear that interacts with the fire-control/safety selector (also often referred to as a safety lever), the trigger and the hammer (also referred to as a striking piece), is designed in one piece. Examples are U.S. Pat. No. 10,330,413 B2, EP 2 950 033 B1, and U.S. Pat. No. 7,600,338 B2, from which these relationships can be seen very clearly.

Reference is also made to US 2016/0363401 A1, which discloses a modular hammer-trigger system in which, as can be seen particularly well in FIG. 7, both a disconnector and a sear are rotatably mounted in recesses of the trigger and are biased by means of springs. The hammer and trigger can be rotated in a common module by means of needle bearings and are also biased by means of springs. The various springs, the requirement for the spring to fit in very small spaces, and the tight geometric dependencies required to fulfill the individual functions of the springs are problematic, even if one assumes that maintenance only takes place in an armory and/or with the use of special tools.

Another common concern is the shooter's interest in having a trigger unit that requires a two-stage build-up of resistance until the shot is fired. These trigger resistances should be perceived and distinguishable by the shooter when the trigger is operated. Here, too, a large number of two-stage trigger units are known to have a first trigger pull resistance (e.g. "pre-trigger resistance") and a second trigger pull resistance (e.g. "main trigger resistance"). Overcoming the first and second trigger resistances is often referred to in English as the "first stage" and the "second stage." The previously cited U.S. Pat. No. 7,600,338 B2, and US 2019/257606 A1, should be mentioned as representative of the many different design options for two-stage trigger units since very different components are responsible for their operation.

The content of DE 20 2011 004 556 U1, EP 2 950 033 B1, US 7,600,338 B2, U.S. Pat. No. 10,330,413 B2, US 2016/0363401 A1, and US 2019/257606 A1 are incorporated by reference to the content of the present application for jurisdictions in which this is possible.

SUMMARY

The present disclosure concerns a modular system for a trigger unit for a firearm, where the trigger unit is designed as a drop-in trigger unit to complement a trigger pocket of the lower receiver of the firearm, and that the trigger unit is received by the trigger pocket, preferably completely.

In one example, the disclosure includes a trigger unit for a firearm having a trigger pocket in a lower receiver, wherein the trigger unit is arranged in a trigger housing and configured to be a drop-in trigger unit that complements the trigger pocket, such that the trigger housing is received by the trigger pocket.

In another example, the disclosure includes a lower receiver of a firearm, the lower receiver defining a trigger pocket for receiving a modular drop-in trigger unit, where the trigger unit is arranged in a trigger housing and the trigger pocket includes lateral guides configured to support the trigger housing and secure it within the trigger pocket.

In another example, the disclosure includes a firearm including a breech, an upper receiver, and a lower receiver, where the lower receiver defines a trigger pocket for receiving a modular drop-in trigger unit, the trigger unit is arranged in a trigger housing, and the trigger pocket includes lateral guides configured to support the trigger housing and secure it within the trigger pocket. When the modular drop-in trigger unit is installed in the trigger pocket the modular drop-in trigger unit is secured from movement from above by the upper receiver and/or the breech.

DETAILED DESCRIPTION

Figure 1:
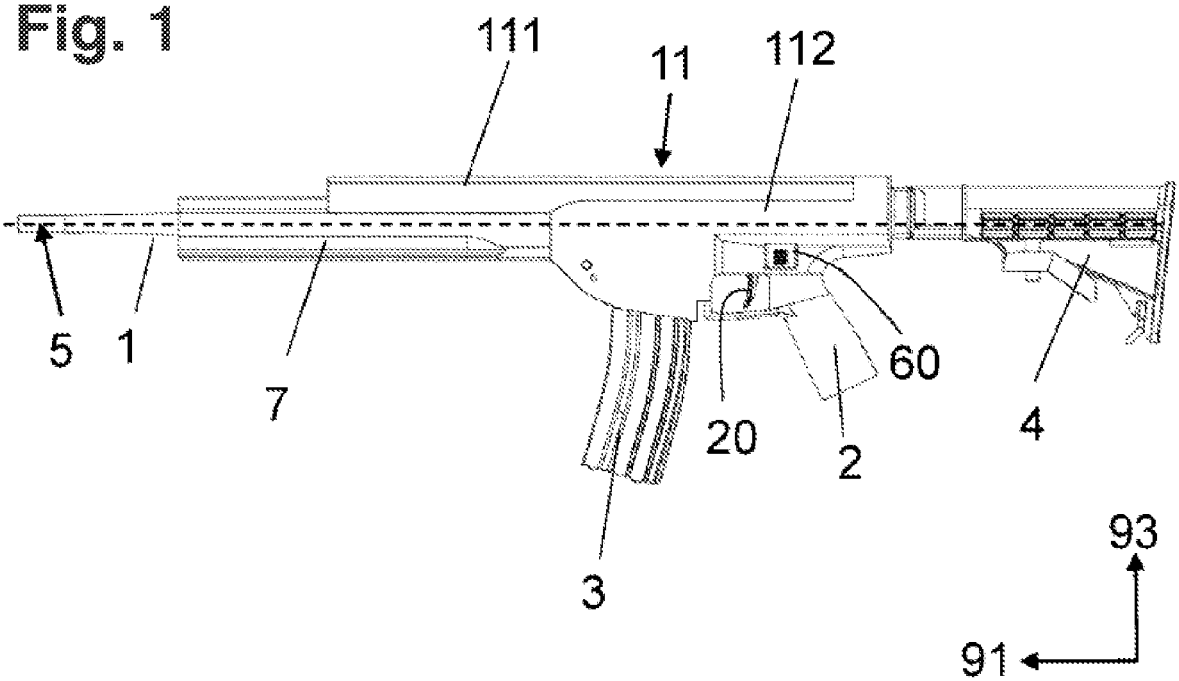
FIG. 1 shows a simplified representation of a firearm according to the prior art.

The present disclosure relates to a trigger for a firearm with a sear, a sear axis, a trigger lever with a trigger axis, a disconnector with a joint and a hammer rotatable about a hammer axis having a hammer spring. The disclosure also relates to the accommodation of such a trigger in a receiver, whereby a drop-in trigger unit is created which is simply pushed into the weapon, preferably its lower receiver, if it has a lower receiver, whereby the drop-in trigger unit is fixed by the upper receiver. The disclosed trigger can include a fire-control/safety selector as a rotational lever or as a sliding lever. The present disclosure further relates to firearms that contain one or more of these components.

The trigger units, receivers, and firearms of the present disclosure, and their variants, are not limited to use in rifles, carbines, etc., but can, in principle, also be used in certain pistols. The improvements achieved and the effects/advantages of these improvements are stated below. Since such trigger units can be used interchangeably as a module in existing weapons and the weapons themselves only provide the geometric and functional boundaries for their use, the invention primarily relates to a trigger unit and only secondarily to a weapon having such a trigger unit.

The present disclosure provides a trigger unit which enables the firearm to be secured with the fire-control/safety selector able to turn to the "safe" position when the hammer is in the behind or downward position. The present disclosure also provides, with at least one embodiment, a two-stage or three-stage trigger unit with different trigger resistances are provided.

The present disclosure further provides a fire-control/safety selector that is easy to use and, if necessary, easy to replace.

In one aspect of the disclosure, the total number of components of a trigger assembly are kept as low as possible and their arrangement in the receiver of a firearm is made as positionally stable and as easy to replace as possible.

Furthermore, in one variant, the present disclosure provides a trigger unit that is easy to handle, easy to maintain and relatively easy to replace as a modular "drop-in" trigger unit.

The trigger unit of the disclosure comprises a hammer that is rotatably mounted about a hammer axis and can be biased by means of a hammer spring, wherein the hammer spring has a first arm and a second arm, a trigger lever that is rotatably mounted about a trigger axis and which, preferably integrally formed with it, has a trigger that, when viewed in a normal direction, lies below the trigger axis and is moved against a running direction when the trigger unit is actuated, wherein the trigger lever has a trigger rear part that is designed to accommodate at least one disconnector, as well as a sear rotatably mounted about a sear axis and can be biased by means of a sear spring, wherein the hammer axis, the trigger axis and the sear axis are arranged parallel to one another and parallel to a transverse direction. The trigger lever has a recess and the sear is at least partially arranged within the recess of the trigger lever so that the sear axis and the trigger axis coincide, and the sear has a bearing on its upper side for receiving and limiting rotation around a disconnector axis of a disconnector joint formed on the underside of the disconnector. In addition, the bearing is designed to at least partially surround the disconnector joint in the direction of rotation about the disconnector axis.

In other words, the sear and the trigger lever have a common axis of rotation, such that the sear axis and the trigger axis coincide. The sear has a bearing on its upper side for receiving and limiting rotation about a disconnector axis of a disconnector joint formed on the underside of the disconnector, and the bearing for the disconnector joint is at least partially designed to enclose the disconnector axis in the direction of rotation. In this way, the hammer, which is rotatably mounted about the hammer axis and can be biased by means of a hammer spring, is no longer blocked by the trigger when it is in the behind or downward position.

The trigger lever, which is mounted rotatably about the trigger axis, comprises an integral trigger and a trigger rear part that is designed to accommodate the disconnector, or at least one disconnector. The inventive design and arrangement, and the interaction of the sear, disconnector and trigger lever, allow for the adjustment of the fire-control/safety selector when the hammer is in the behind or downward position to the "safe" position, since the rear part of the trigger can be easily deflected in this state. The bearing and the disconnector joint are designed to be substantially complementary to one another in terms of shape and function in order to allow a rotation around the disconnector axis within limits. The assembly can be carried out simply by pushing together laterally, as is explained in more detail in the description of the figures. In the installed condition, this also prevents the components of the trigger unit from being lost.

The subject matter of the present description includes all novel and nonobvious combinations and subcombinations of the various elements, features, functions, and/or properties disclosed herein. Other combinations and subcombinations of features, functions, elements, and/or properties, such as those relating to, among other things, differently designed trigger units, in particular a modular "drop-in" trigger unit, a "pull-through" trigger unit, and housing components for receiving these trigger units, as well as the design of fire-control/safety selectors, may be claimed in applications claiming priority from this or a related application. Such claims, whether broader, narrower, equal, or different in scope to the original claims, also are regarded as included within the subject matter of the present disclosure. For the sake of simplicity and clarity, these aspects are explained in detail using the following description of the figures.

The terms left, right, top, bottom, front and rear always refer to the shooter's view in the firing direction of the firearm when it is held in a ready to fire position. The weapon has, going through the barrel axis and oriented vertically, a weapon center plane, which forms a plane of symmetry.

In the description and the claims, the terms "front," "rear," "above," "below" and so on are used in the generally accepted form and with reference to the object in its usual use position. This means that, for the firearm, the mouth (also referred to as the muzzle) of the barrel is "at the front," and that the breech is moved "rearward" by the force of explosive gas, etc. Transverse to a direction substantially means a direction of rotation by 90°.

In the figures described below, the barrel direction (e.g. towards the mouth/muzzle of the barrel) is indicated by arrow 91, the normal direction upward with arrow 93 and the transverse direction to the left with arrow 92.

In FIG. 1, a firearm with barrel 1, grip 2, magazine 3, stock 4, handguard 7, trigger as part of the trigger unit 20, fire-control/safety selector 60 and receiver 11, which comprises an upper receiver part 111 and a lower receiver part 112, is shown schematically and includes the dashed line designating the bore axis 5 as well as the direction of movement forward with arrow 91 and normal direction upward with arrow 93.

Trigger

Figure 2:
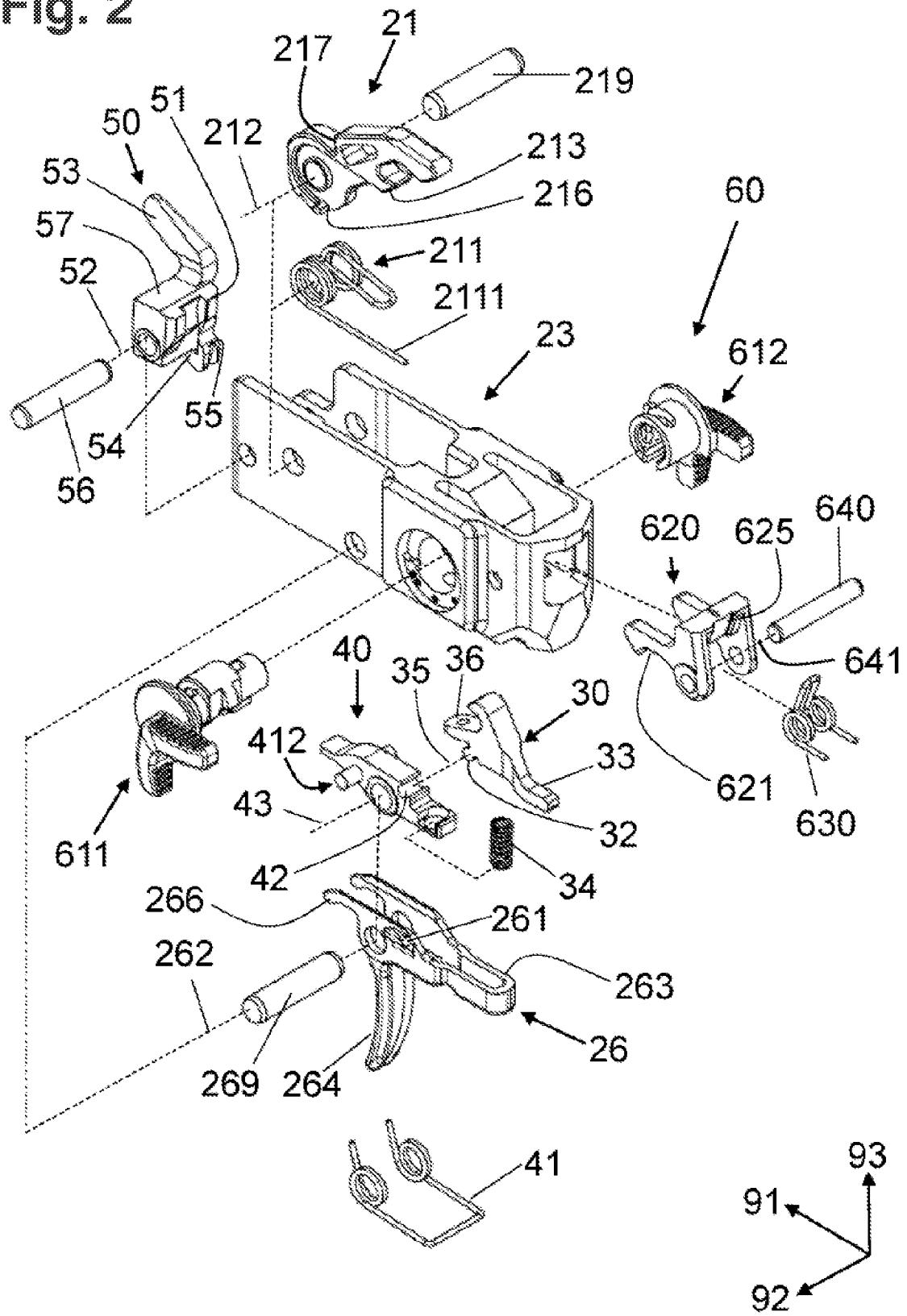
FIG. 2 shows a simplified exploded perspective view of an illustrative trigger unit according to the present disclosure.

FIG. 2 shows a schematic exploded view of an exemplary embodiment of a trigger according to the present disclosure. As shown, the trigger is preferably designed as a trigger unit 20 (FIG. 18) with a trigger housing 23. The dashed lines indicate the arrangement of the components for the trigger unit 20 (FIG. 18) for assembly.

Figure 18:
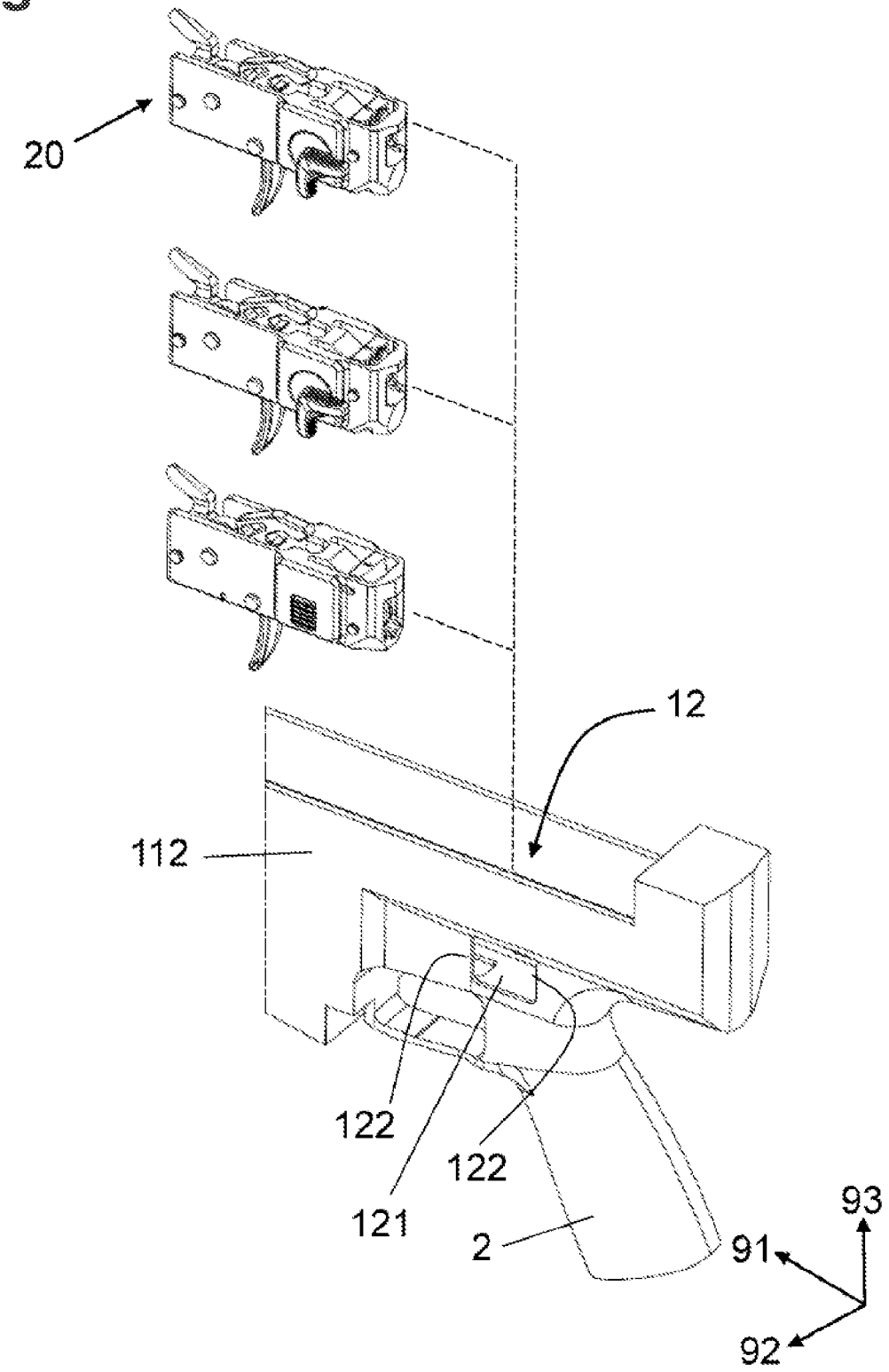
FIG. 18 shows a plan view of the modular trigger unit configurations and a firearm's lower receiver.

The trigger comprises at least one hammer 21, a trigger bar 264, a trigger rear 263, a sear 40, and a disconnector 30. In a preferred embodiment, which is described below, the trigger according to the present disclosure is arranged in a trigger housing 23 and is referred to as a trigger unit 20 (FIG. 18). However, it is also possible to arrange the trigger directly in a receiver 11 (FIG. 1) of a firearm, preferably in a lower receiver part 112 (FIG. 1), without a trigger housing 23.

As is often the case, the hammer 21 is rotatably supported by a hammer pin 219 about the hammer axis 212 and protrudes partially upward out of the trigger housing 23 in the normal direction 93 and, as described further below, is biased by the hammer spring 211.

The trigger lever 26 is rotatably mounted about the trigger axis 262, for example by means of a trigger pin 269 in the trigger housing 23, wherein the trigger axis 262 is arranged behind the hammer axis 212 when viewed in the barrel direction 91 to the front.

Figure 3A:
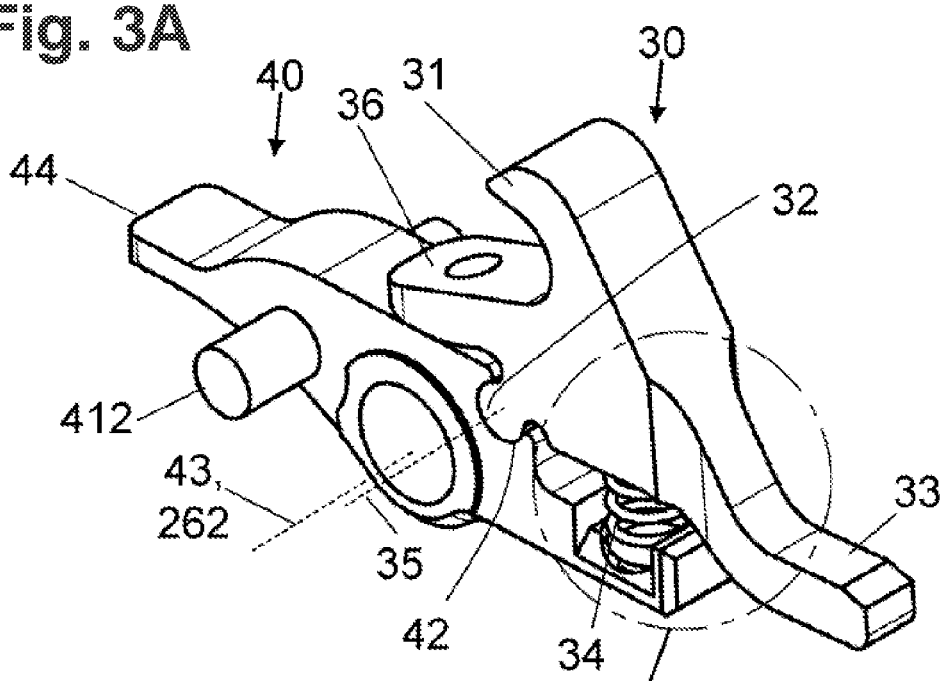
FIGS. 3A and 3B show a detailed view of the sear of the trigger unit of FIG. 2 with a disconnector.
Figure 5A:
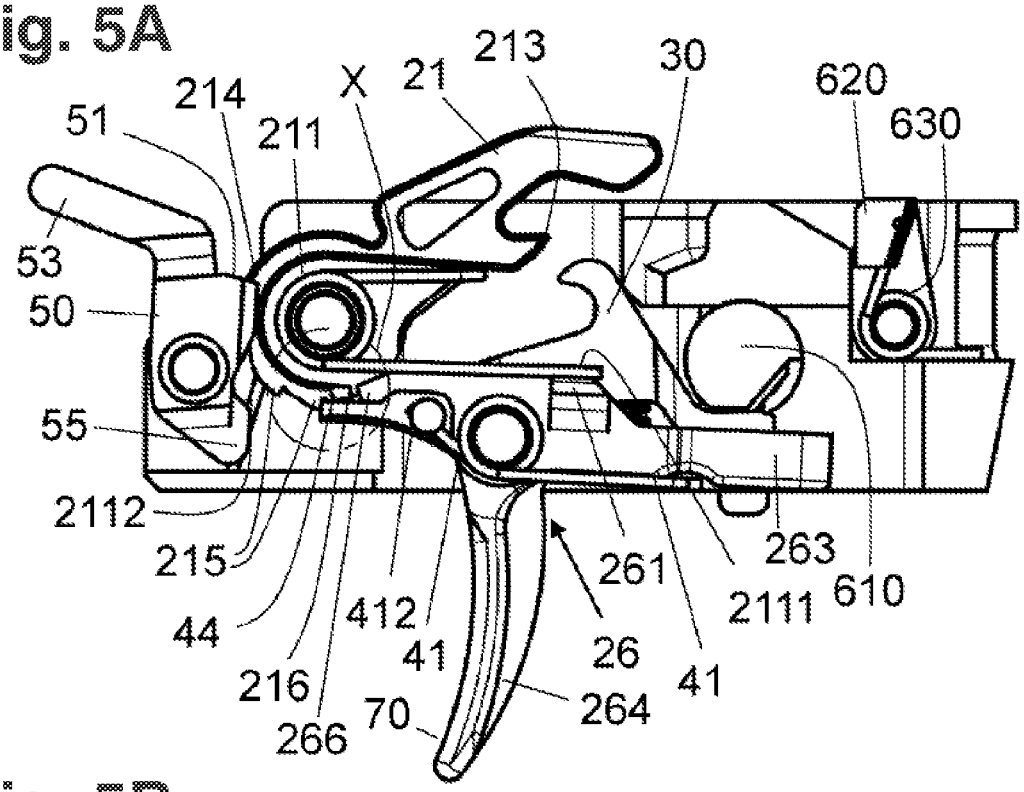
FIGS. 5A and 5B show a plan view and a section view of the illustrative trigger unit in the rest position.
Figure 10A:
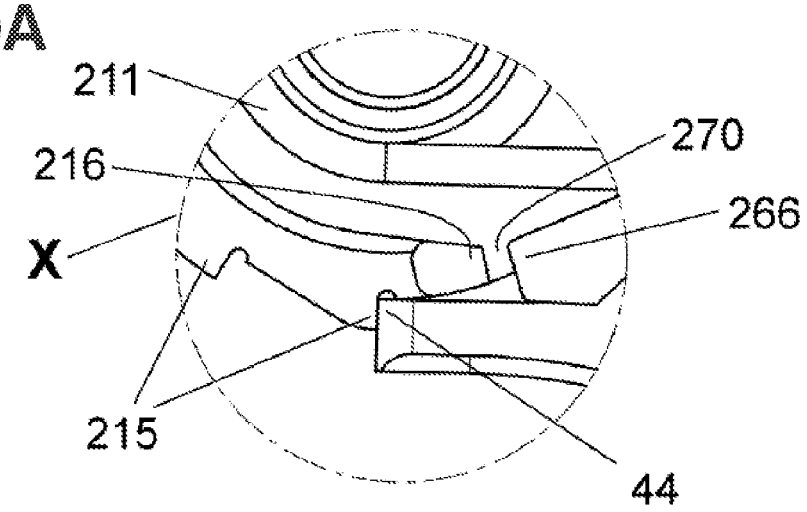
FIGS. 10A-10C show detailed views of the hammer cams and the sear edge in different trigger stage positions of the illustrative trigger unit.

The mechanical engagement on the hammer 21 or its hammer cam 215 (in the prior art often also referred to as a trigger catch on the hammer or hammer catch, see also, for example, FIG. 5A and 10A) does not take place directly with the trigger lever 26—as known in the prior art—but indirectly, via the separately designed sear 40, which has a sear edge 44 (also called a trigger sear, see also, for example, FIGS. 3A and 5A). According to the present disclosure, the sear 40 and the trigger lever 26 have a common axis of rotation in the installed condition, which is accordingly referred to as both the trigger axis 262 and the sear axis 43.

In addition, the sear 40 is connected to a disconnector 30 according to the present disclosure in that the sear 40 has a bearing 42 on its upper side for receiving a disconnector joint 32 formed on the underside of the disconnector 30. The bearing 42 surrounds the disconnector joint 32 at least partially (preferably to over 180° in the direction of rotation about the disconnector axis 35, which runs in the transverse direction 92 through the disconnector joint 32. In the installed condition, this allows a limited rotation of the disconnector 30 about the disconnector axis 35 and, due to the formation of the common sear axis 43 and trigger axis 262, the sear 40 and the disconnector 30 can be tilted or rotated within limits, both individually and together. The sear 40 and the disconnector 30 are preferably at least partially received by the trigger lever 26, which, as shown, is then divided in the form of a recess.

A sear spring 41 which is essentially U-shaped when viewed from above and approximately L-shaped when viewed from the side is also arranged on both sides of the trigger lever 26, each having one or more turns in the kink areas of the "L." The sear spring 41 is held in the trigger unit 20 (FIG. 18) by the trigger pin 269, which protrudes through the windings. The leg of the sear spring 41, which is at the rear in the installed condition, engages the underside of the trigger housing 23 in the illustrated embodiment; see also FIG. 5A, for example. This type of spring support can also be achieved by a person skilled in the art in a different manner, for example by means of corresponding support points on the inside of a firearm's lower receiver 112 (FIG. 1). However, according to the present disclosure, the two loose ends of the sear spring 41 are supported on the sear 40 on sear spring supports 412 (FIG. 3A) provided on the underside thereof. These points of application are "in front of" the sear axis 43. As a result, a sear edge 44 (FIG. 5A) at the front end of the sear 40 is biased upward, in the direction of the hammer 21.

Figure 4A:
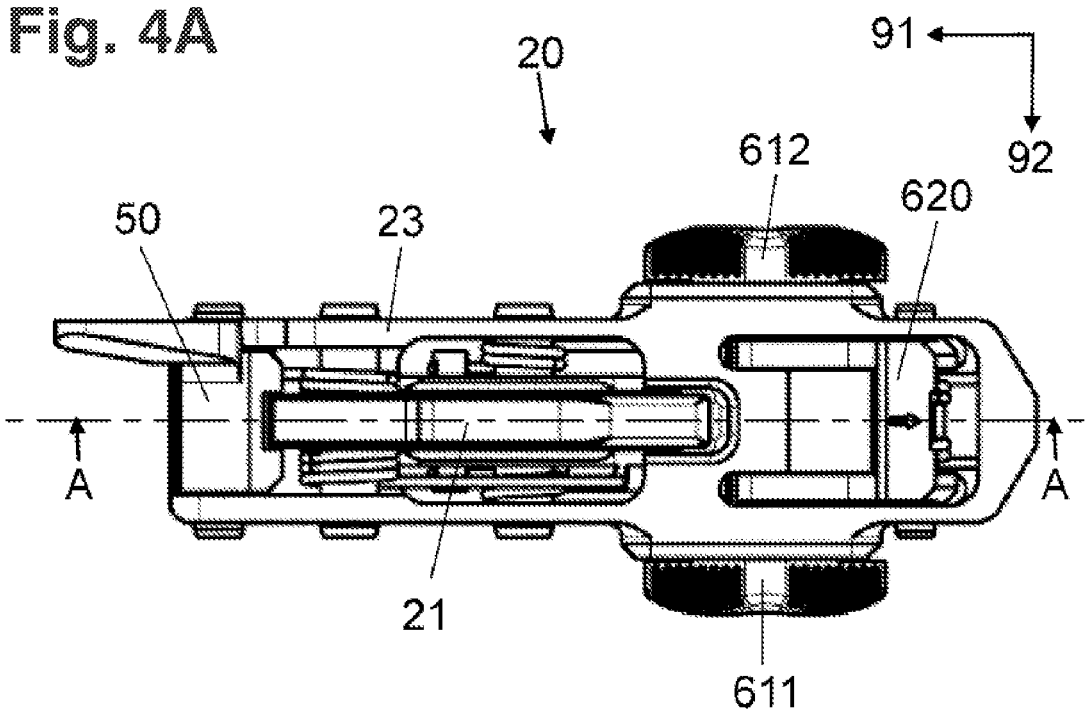
FIGS. 4A and 4B show a plan view of the illustrative trigger unit from above and from the side.
Figure 4B:
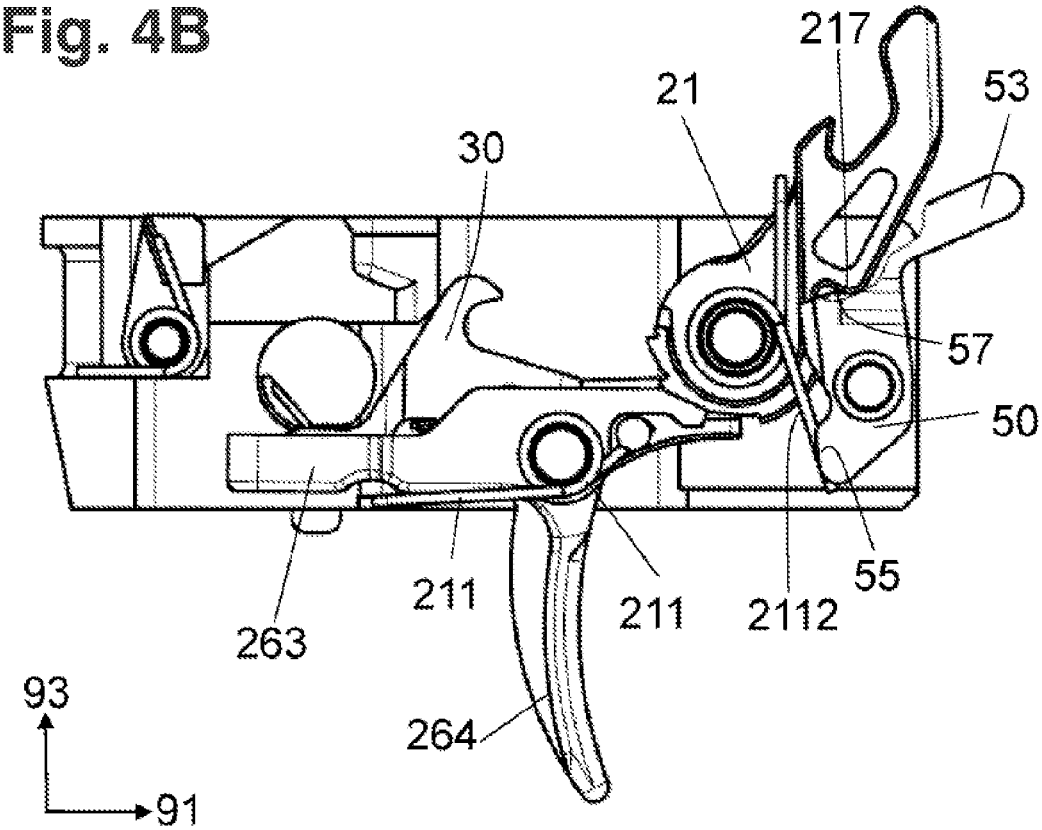

The hammer spring 211 comprises a first arm 2111, a first spiral (screw winding), a central and essentially U-shaped connecting piece, a second spiral, and a second arm 2112 (see FIG. 4B). The first arm 2111 and the second arm 2112 are not designed, as is often the case in the prior art, arranged parallel to one another, but preferably, as shown, at an angle to one another (projected into the weapon's center plane, to which the axis of the spirals are at least approximately normal).

The hammer 21 is biased in the installed condition by means of the hammer spring 211. The hammer spring 211 is tensioned in the usual way with the central connecting piece of the hammer spring 211 from below against the hammer 21, and the first arm 2111 can be counter-supported by the trigger pin 269, for example. In the embodiment shown, as can be seen from viewing FIG. 1 together with FIG. 5A, a laterally protruding hammer spring support 261 can be provided on the trigger lever 26 which acts as an abutment for the first arm 2111 of the hammer spring 211, whereby an abutment of the hammer spring 211 against the sear spring 41 can be avoided. This support of the hammer spring 211 on the hammer spring support 261, which is preferred according to the present disclosure, also results in a force transmission which presses the trigger lever 26 with its trigger rear 263 downward in the normal direction 93. This relationship is advantageous for the design of the trigger unit 20 (FIG. 18) according to the present disclosure, since it transmits a force to be overcome on the trigger lever 26 and thus noticeably for the shooter on the trigger bar 264, which is perceived as the first trigger stage 71 position (FIGS. 7A and 7B) (often referred to as the "first stage" in English) and defines the resistance in the idle tension, which will be explained later.

The second arm 2112 of the hammer spring 211, which, as is difficult to see in FIG. 2, protrudes obliquely forward, can be supported on a spring seat 55, which is formed on the leg 54 of an auto sear 50 below the auto sear axis 52. In the exemplary embodiment shown, the auto sear 50 is rotatably mounted around the auto sear axis 52 in the trigger housing 23 by means of the auto sear pin 56, wherein the auto sear axis 52 is arranged "in front of" the hammer axis 212. The auto sear 50 comprises a top 53 protruding upward from the trigger housing 23 in the normal direction 93, an auto sear edge 51 (see also FIG. 5B) and a hammer stop 57. The spring bias of the hammer spring 211 pushes the top 53 of the auto sear 50 backward; in the installed condition (e.g. in the locked position) this movement is limited by a bolt carrier (not shown), as further explained in the descriptions below (FIG. 8B).

As also shown in FIG. 2, the trigger lever 26 can have at least one spur 266 which protrudes forward in the area of the trigger axis 262 and is oriented substantially parallel to the barrel direction 91 and which acts as a drop guard in cooperation with the hammer 21. Two spurs 266 are preferably designed, one on each of the two sides of the trigger lever 26, symmetrical to the weapon's center plane. More detailed explanations are described below (see, e.g., details X in FIGS. 5A, and 10A-10C).

The trigger according to the present disclosure can be designed as a two-stage trigger, or as a three-stage trigger (hereinafter also referred to as a "pull-through trigger"). In the two-stage version, the trigger can assume a rest position 70 (FIGS. 5A and 5B) (not actuated), a first trigger stage position 71 (FIGS. 6A and 6B) after overcoming the idle tension and a second trigger stage position 72 (FIGS. 7A and 7B) after increasing the force on the trigger bar 264. In the second trigger stage position 72 (for example depending on the position of the fire-control/safety selector 60), individual shots (single fire) and/or multiple automatic shots (continuous fire) can be released.

Analogous to the two-stage design, the three-stage "pull-through trigger" can also assume a rest position 70, a first trigger stage position 71 and a second trigger stage position 72. In addition, the trigger can take a further, third trigger stage position 73. The second trigger stage position 72 allows the firing of individual shots (single fire), the third trigger stage position 73 is reached after increasing the force on the trigger bar 264 and allows the automatic firing of multiple shots (continuous fire).

The trigger according to the present disclosure can, as shown, be designed with a fire-control/safety selector 60 which, in a special embodiment, is arranged normal to the weapon's center plane when in the installed condition. The fire-control/safety selector 60 allows a desired fire selection position to be selected, with at least two positions—"safe" and "fire" — being possible. Depending on the embodiment of the trigger and the fire-control/safety selector 60, the "fire" position can allow, for example, a single shot ("single fire" position) and/or automatic firing of multiple shots ("continuous fire" position).

In special embodiments, at least one further firing position of the fire-control/safety selector 60, for example "continuous fire," is also possible. In the case of military variants in particular, in addition to the "continuous fire" position, a "burst" fire position may also used, whereby the automatic firing of shots is stopped after, for example, three shots. These additional firing positions are usually known to the person skilled in the art and do not require any further explanation here.

In the "safe" position, the fire-control/safety selector 60 blocks the movement of the trigger lever 26 and the reaching of the second trigger stage position 72. In the position "fire" (which can be a "single fire" position and/or a "continuous fire" position) the fire-control/safety selector 60 releases the movement of the trigger lever 26 to reach the second trigger stage position 72 and—if available—the third trigger stage position 73.

The fire-control/safety selector 60 can be designed as a rotary selector 610 (FIGS. 6-8) or as a sliding selector 650 (FIGS. 14-17) with an analogous function. Details of a preferred embodiment of a rotary selector 610 with rotary levers (611, 612) and locking lever 620 are shown in FIGS. 11-13. A special embodiment of a sliding selector 650 is shown in FIGS. 17A-17C.

At this point it should be pointed out that, within the scope of the present present disclosure, different and even arbitrary combinations of the described two- or three-stage trigger with a rotary selector (610) or sliding selector (650) device with two or three firing positions can be implemented.

To the person skilled in the art it will be clear from the following description and analysis of FIGS. 3 to 10 that further objects according to the present disclosure are achieved with the aid of the one-piece components shown as examples, in particular the trigger lever 26, the sear 40, the disconnector 30 and the hammer 21. It should already be noted here that multi-part sears 40 and/or disconnectors 30 that interact in an analogous manner are also conceivable.

Figure 3B:
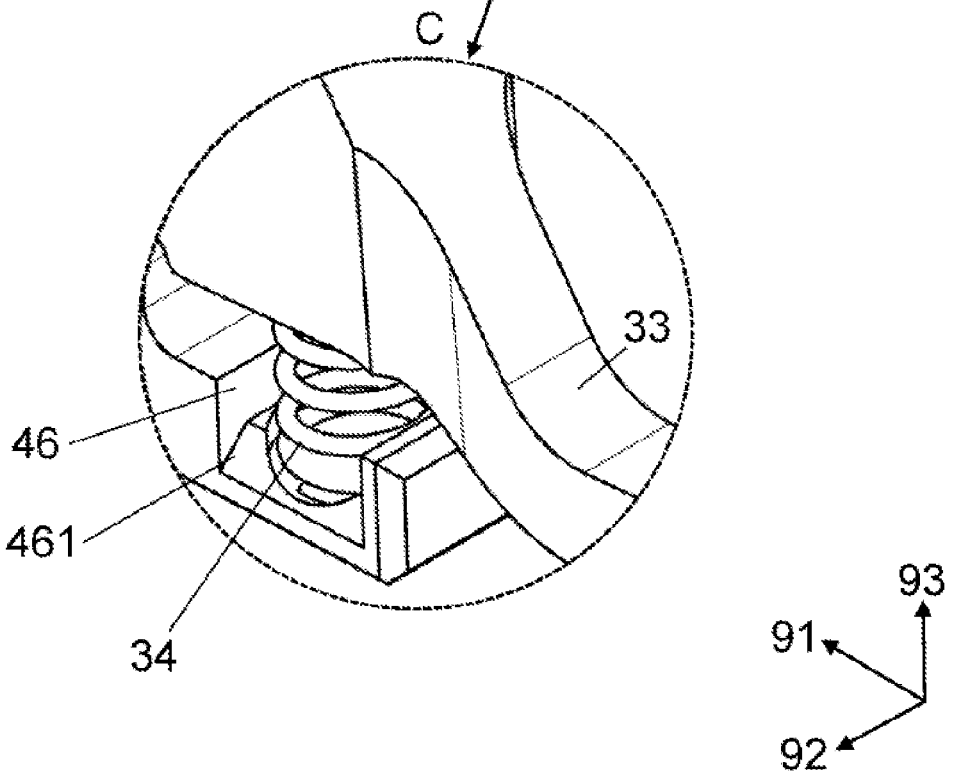

In FIGS. 3A and 3B, the sear 40 and the disconnector 30 are shown in a first embodiment on an enlarged scale. The disconnector 30 has a disconnector hook 31 on the upper side, which cooperates with the hammer hook 213 (FIG. 2). At its rear end, the disconnector 30 can have an optional back end 33 which, in the embodiment shown, has a smaller extension in the transverse direction 92 than the central or front section. This enables easier reception/introduction in and/or into the trigger rear 263. As shown, the disconnector 30 can have a type of finger 36 (FIG. 2) in the front section for guiding along the top of the sear 40. The guidance and/or also the support on the upper side of the sear 40 can, however, also take place through an alternative and functionally identical design of the pairing of the bearing 42 and the disconnector joint 32.

The disconnector 30 has a disconnector joint 32 on its underside, which has a circular cylindrical section with an axis that runs in the transverse direction 92. This serves for the receiving and rotatably mounting on the upper side of the sear 40, on which a circular cylindrical recess is formed in a complementary shape, whereby a disconnector axis 35 is defined in the transverse direction 92. Furthermore, a spring recess 46 for a disconnector spring 34 is formed on the underside of the disconnector 30. This receptacle, which can be better seen in cross section views, for example in FIG. 6B, is adapted in diameter and depth to the disconnector spring 34 in such a way that it is secured to prevent it from slipping out laterally.

In a preferred embodiment, the sear 40, as shown enlarged in detail C in FIG. 3B, also has a spring recess 46 which is designed as a depression in the direction of the axis of the disconnector spring 34. This spring recess 46 is formed on the upper side of the rear of the sear 40, that is to say facing the disconnector 30, and, like the receptacle in the disconnector 30, serves to at least partially receive and prevent the loss of the disconnector spring 34. In the advantageous development shown, the spring recess 46 is partially open in at least one transverse direction 92, which facilitates assembly, since the disconnector spring 34 does not have to be compressed to the extent that it can be inserted into the recess or receptacle. A ramp 461 provided laterally in the area of the opening to the spring recess 46 provides further assistance during assembly. Due to the rise of the ramp 461 in the direction of the spring recess 46, the disconnector spring 34 can be inserted more easily from the side (i.e. moved over it).

In all the embodiments described, however, the function of the disconnector spring 34 is the same in that it biases the disconnector 30 about the disconnector axis 35, i.e. substantially upward in the direction of hammer hook 213 (FIG. 2) (counterclockwise in the illustration of FIG. 3A). The bearing 42 is designed to be substantially complementary in shape and function to the disconnector joint 32, as a result of which, in addition to the receptacle, a partial rotation of the disconnector 30 within defined rotational limits is made possible. The assembly of the sear 40 and the disconnector 30 takes place, because of the contact area exceeding 180° and the connection achieved in this way, by shifting from one side in the transverse direction 92, whereby an undesired, independent dismantling or falling apart during operation due to the lateral limitation within the trigger lever 26 (FIG. 2) is avoided.

Looking together at FIGS. 4 to 10 and FIGS. 15 to 16, the function and the sequence of movements of the trigger according to the present disclosure, shown in a special embodiment as a modular trigger unit 20 (FIG. 18), are clear to those skilled in the art. As already described above, the different positions of the trigger bar 264 are referred to as the rest position 70, the first trigger stage position 71, the second trigger stage position 72 and, in the case of a pull-through trigger, the third trigger stage position 73.

FIG. 4A shows an embodiment of the modular trigger unit 20 (FIG. 18) according to the present disclosure as a plan view from above. The section line A-A shows the section plane for the sections shown in FIGS. 6-8. FIG. 4B shows a partially cut-out side view of an embodiment of the modular trigger unit 20 from the right in the area of the hammer 21 and auto sear 50 and can be read in conjunction with FIG. 5A (side view from the left). The second arm 2112 of the hammer spring 211, which is supported in the spring seat 55 of the auto sear 50, can be seen very clearly in FIG. 4B. In the illustration shown, the hammer 21 is depicted in the fully upward state, i.e. the hammer 21 is in its most possible front position. This position is only reached if there is no firing pin present to block the forward movement of the hammer 21 and stop it prematurely, i.e. usually when the hammer 21 is removed or if the firing pin is broken, etc.

As shown, a hammer recess 217 can be formed on the hammer 21 in a special embodiment, which strikes a hammer stop 57 of the auto sear 50 in such a way that the auto sear edge 51 (FIGS. 2 and 5B) adjacent to the hammer stop 57 remains untouched and protected. Such a design and the protection of the auto sear edge 51 in the behind state is advantageous, since mechanical blows of the hammer 21 on the auto sear edge 51 would cause the hammer 21 and/or the auto sear edge 51 to wear unnecessarily and prematurely. The service life of the auto sear lever 50 assembly and the hammer 21 are thus extended by this measure.

In FIG. 5A an embodiment of the trigger is shown in side view (from the left) in the rest position 70. In the rest position 70, the trigger is not actuated, so the trigger bar 264 is spring-biased without any external force.

Figure 5B:
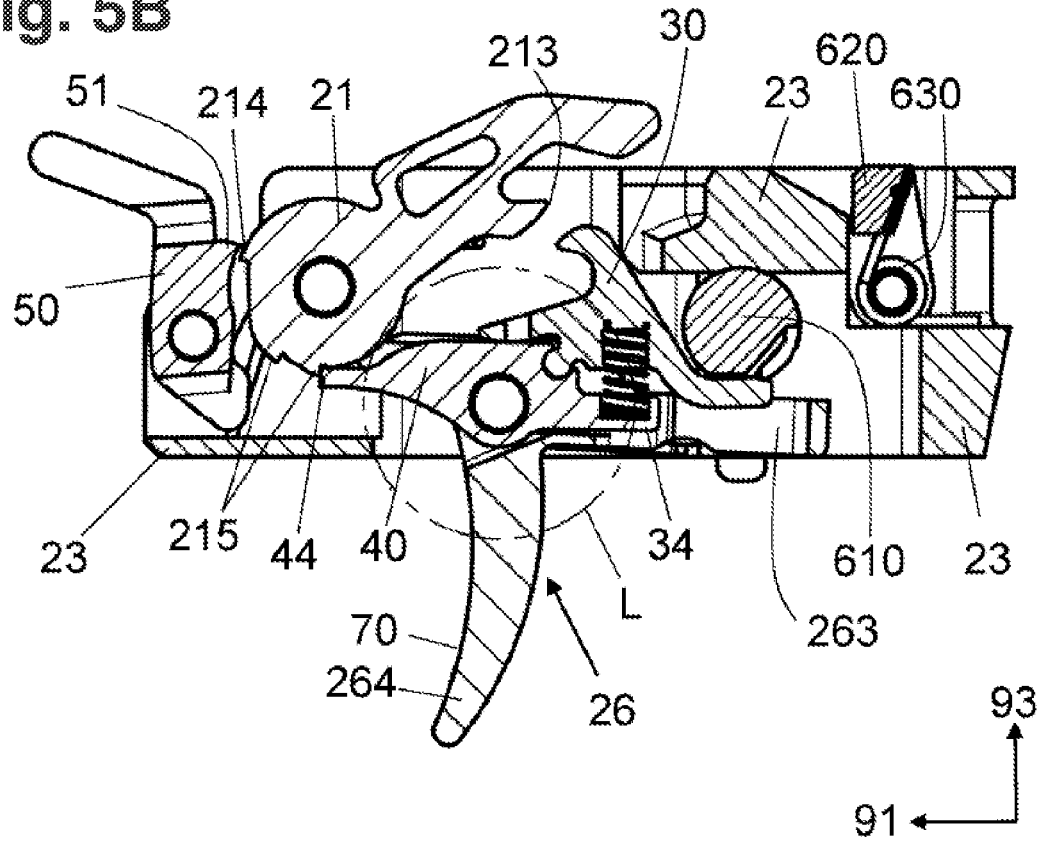

FIG. 5B shows the rest position 70 in a section along the sectional plane A-A of FIG. 4A. The hammer 21 is under tension, that is, the hammer spring 211 (FIG. 5B) tries to rotate the hammer 21 counterclockwise around the hammer axis 212 (FIG. 2), while its first arm 2111 rests on the hammer spring support 261 (FIGS. 2 and 5A). In the area of the hammer axis 212, the hammer 21 has at least one hammer cam 215 on its outer surface, which is held in the rest position by a sear edge 44 of the sear 40 (for detailed views of this see FIG. 10A, in connection with the further trigger movement see also FIG. 10B and 10C). The sear edge 44 of the disconnector 30 is biased by the sear spring 41 (FIGS. 2 and 5A) against the hammer 21 by engaging the sear spring supports 412 (FIG. 5A). As shown, the trigger lever 26 is preferably formed integrally, that is to say in one piece, and has a trigger bar 264 that protrudes substantially downward in the normal direction 93. In addition, in a special embodiment, as shown, the trigger lever 26 can have in its middle section and in the rearward direction (toward 91) in the trigger rear 263 a central receiving opening, continuous in direction 93, for receiving the sear 40 and the disconnector 30. As can be seen from FIG. 2, this can be created by the U-shaped design of the trigger lever 26 in this region.

The spring force of the hammer spring 211 or its first arm 2111 (FIGS. 2 and 5A) acts on the hammer spring support 261 and thereby the trigger rear 263 is biased downward. The downward movement of the trigger rear 263 is limited by the lower side of the trigger housing 23 or, if the lower side of the trigger housing is open, by the lower receiver 112 (FIG. 1).

In order to discharge a shot, the trigger lever 26 actually has to be moved beyond the first trigger stage position 71 into the second trigger stage position 72. Otherwise a movement of the hammer 21 is blocked by the sear edge 44 (in cooperation with the hammer cam 215).

In a particular embodiment, at least one spur 266 (in cooperation with the safety cam 216) (FIGS. 2 and 5A) can block the hammer 21, as explained below.

As already described with reference to FIG. 2, the trigger lever 26 can have at least one spur 266 that protrudes forward in the area of the trigger axis 262 and is oriented substantially parallel to the barrel direction 91. Two spurs 266, which are each formed on each of the two sides of the trigger lever 26, are preferably provided. A step-shaped safety cam 216 is formed on the hammer 21 in the area of the hammer axis 212 and is used to lock the spur 266 into place.

Figure 10B:
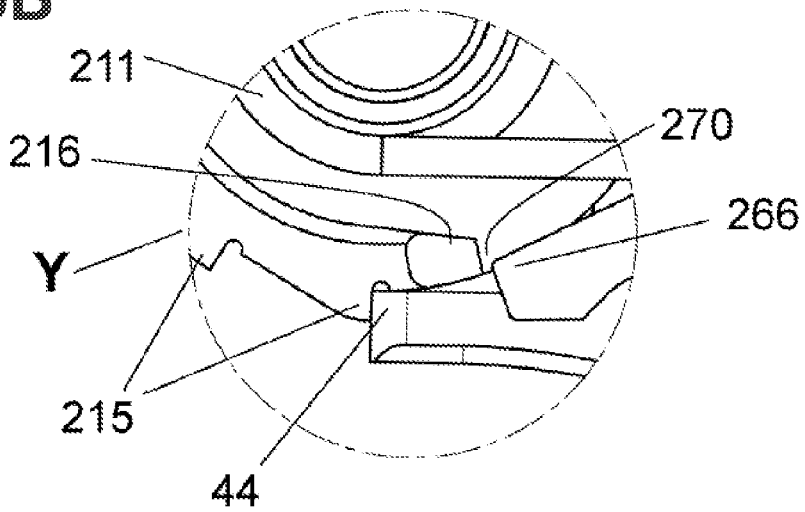
Figure 10C:
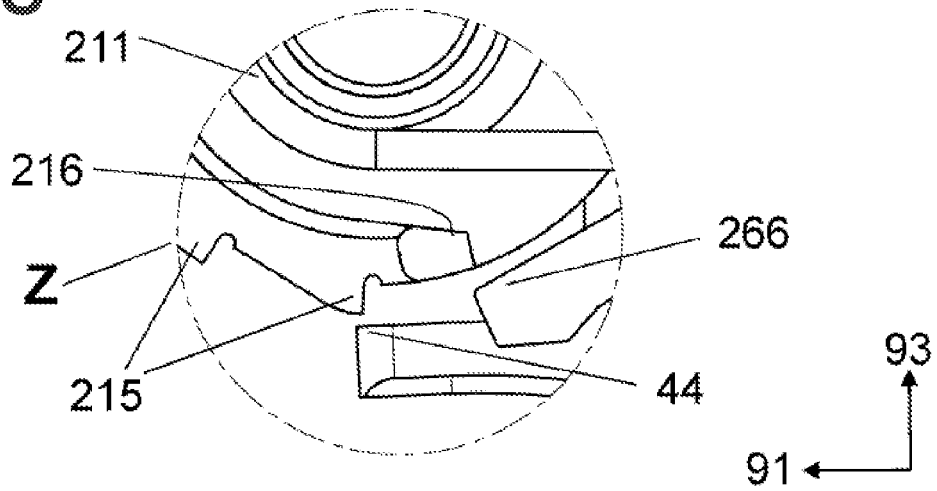

The spur 266 of the trigger lever 26 is, since it lies in front of the trigger axis 262 in the barrel direction 91, biased upward and in the rest position 70 protrudes into the movement path of the safety cam 216 of the hammer 21. In the rest position 70, the spur 266 does not yet touch the safety catch 216 and a small gap 270 (FIGS. 10A and 10B) remains between them (detail X of FIG. 5A, shown enlarged in FIG. 10A). In the event that the firearm is dropped or it experiences some other unforeseen jolt, impact or blow that causes the sear 40 or its trigger edge 44 to inadvertently separate from the hammer cam 215, the spur 266 can interact with the safety cam 216 and help prevent an unintentional upward/forward movement of the hammer 21. The corresponding detailed view X is shown enlarged in FIG. 10A. FIGS. 10B and 10C show the same section, labeled Y and Z, from FIGS. 6A and 7A, correspondingly in the first and second trigger stage positions 71 and 72, respectively.

In this particular embodiment, the intended shot is fired analogously to the sequence described above by overcoming the first or second trigger stage positions 71, 72, whereby when the first trigger stage position 71 is reached, the spur 266 lies outside the path of the safety cam 216 and the movement of the hammer 21 is thus released in the upward/forward direction.

The auto sear 50 is biased by the second arm 2112 of the hammer spring 211, which acts on the spring seat 55, that is, the hammer spring 211 tries (in the illustration of FIG. 5A) to turn the auto sear 50 clockwise about the sear axis 52 (in the illustration of FIG. 4B, but in a differently oriented representation counterclockwise). However, the top 53 of the auto sear 50 is held in position by the bolt carrier (not shown) directly above it against the spring bias toward the front (and down) so that the edge 51 of the auto sear 50 does not protrude into the path of movement of the hammer 21 or the auto sear hook 214. The function of the auto sear 50 can be clearly seen in conjunction with FIG. 8B and is described further below.

The fire-control/safety selector 60 is held in a selectable position by a locking lever 620 which is biased by the locking lever spring 630 acting on the locking lever body 625 (FIG. 2), wherein the locking lever spring 630 is supported on the trigger housing 23 (see also FIGS. 13 and 17). In other words: the locking lever 620 serves, among other things, for temporarily fixing the fire-control/safety selector 60 in a predefined position. The fire-control/safety selector 60, depicted as a rotary selector 610 in the example shown, is in the "safe" position and allows little or no deflection of the trigger lever 26.

Figure 6A:
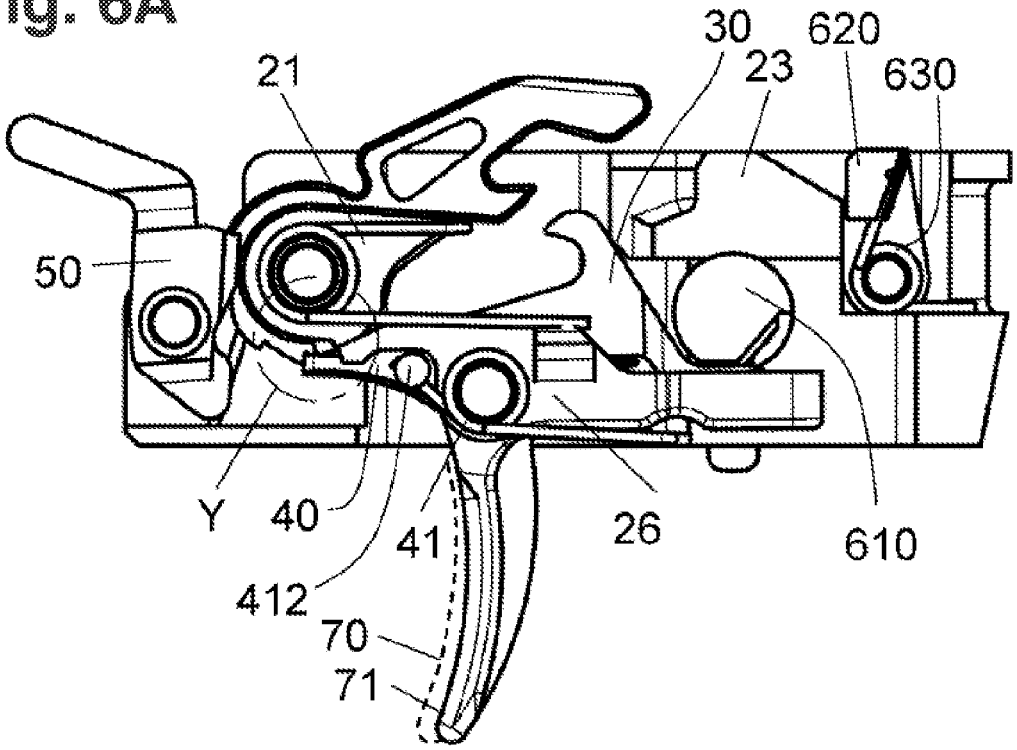
FIGS. 6A and 6B show a plan view and a section view of the illustrative trigger unit in the first trigger stage position.
Figure 6B:
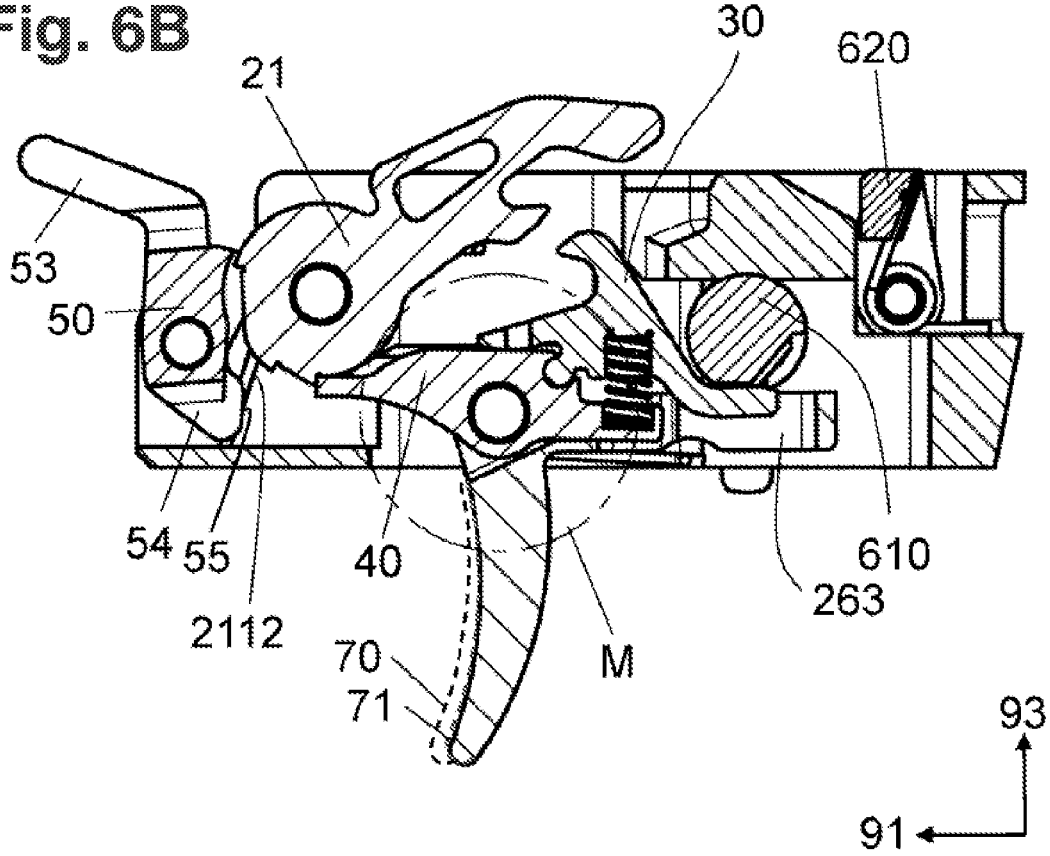

FIGS. 6A and 6B show the trigger unit in the safe state and in the first trigger stage position 71 in a side view and a section along the sectional plane A-A from FIG. 4A. The rear part 263 of the trigger lever 26 is moved slightly upward about the trigger axis 262 by only slight pressure on the trigger bar 264, and the spurs 266 are accordingly moved downward (see above functional description). In the particular embodiment explained above, the movement path of the safety cam 216 can already be released in the first trigger stage position 71 in order to be able to tension the hammer 21 in the first trigger stage position 71 if necessary. The sear edge 44 of the sear 40 does not yet release the movement path of the hammer cam 215 (FIGS. 5A and 5B) of the hammer 21 in this position (see FIG. 10B).

Figure 9A:
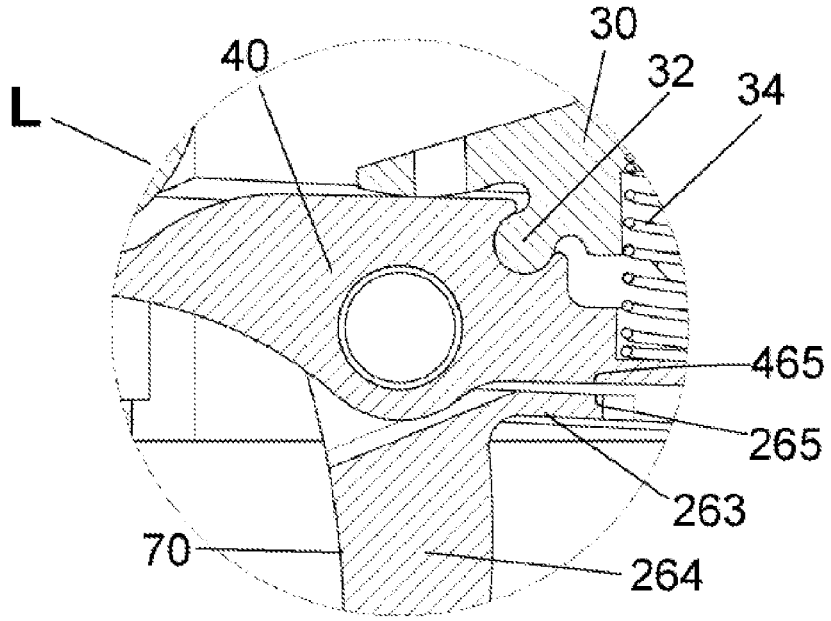
FIGS. 9A and 9Bb show detailed views of the area around the trigger axis and the disconnector joint in the rest position and the first trigger stage position.
Figure 9B:
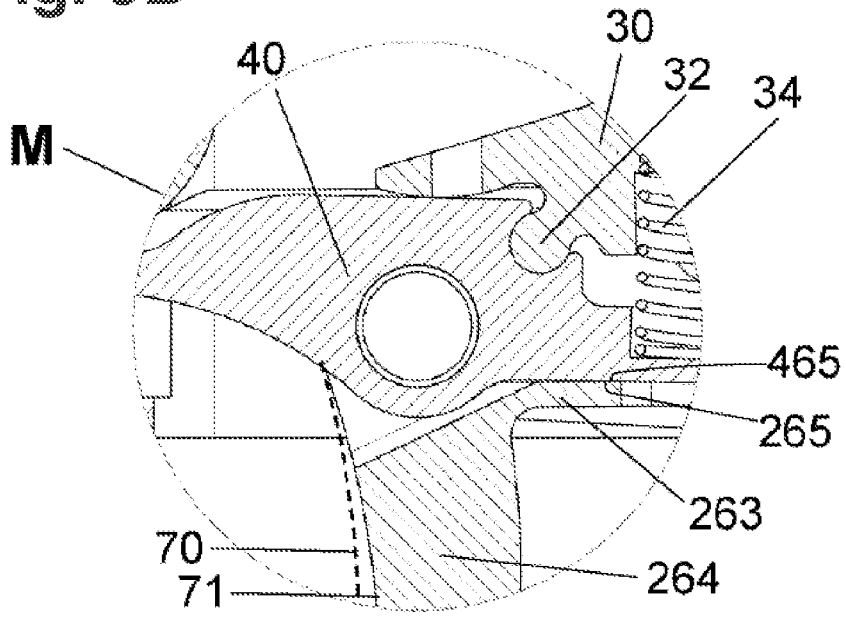
Figure 9B:
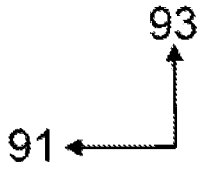

The corresponding detailed views M and L of FIGS. 5B and 6B are shown in FIGS. 9A and 9B, where it can be seen that in the rest position 70, the contact surface 265 of the trigger lever 26 (on the trigger rear 263) is at a small distance from the sear bottom 465, in other words, the contact surface 265 does not touch the sear bottom 465. Only by overcoming the idle tension and reaching the first trigger stage position 71 (FIG. 9B) does the contact surface 265 and the sear bottom 465 come into contact. Only with further pressure on the trigger lever 26 beyond the first trigger stage position 71 does the trigger lever 26 and the sear 40 execute a simultaneous, common rotary movement about the common axis 43, 262 (FIGS. 2 and 3A). In other words, the sear 40 remains immobile from the rest position 70 until the first trigger stage position 71 is reached and the sear 40 does not join in the rotary movement of the trigger lever 26 until the first trigger stage position 71 is reached/exceeded.

As shown in FIG. 10A, the sear 40 lies in the path of movement of the hammer 21 until the first trigger stage position 71 is reached; the sear edge 44 blocks the hammer cam 215. Only with further pressure on the trigger lever 26 beyond the first trigger stage position 71 into the second trigger stage position 72 does the sear 40 with the sear edge 44 release the movement of the hammer 21 with the hammer cam 215 (see in comparison FIG. 10C). In the safe position shown in FIGS. 6A and 6B, however, the fire-control/safety selector 60, shown in the variant as a rotary selector 610, prevents further movement of the trigger lever 26 beyond the first trigger stage position 71, since the trigger rear 263 strikes the rotary selector 610.

Figure 7A:
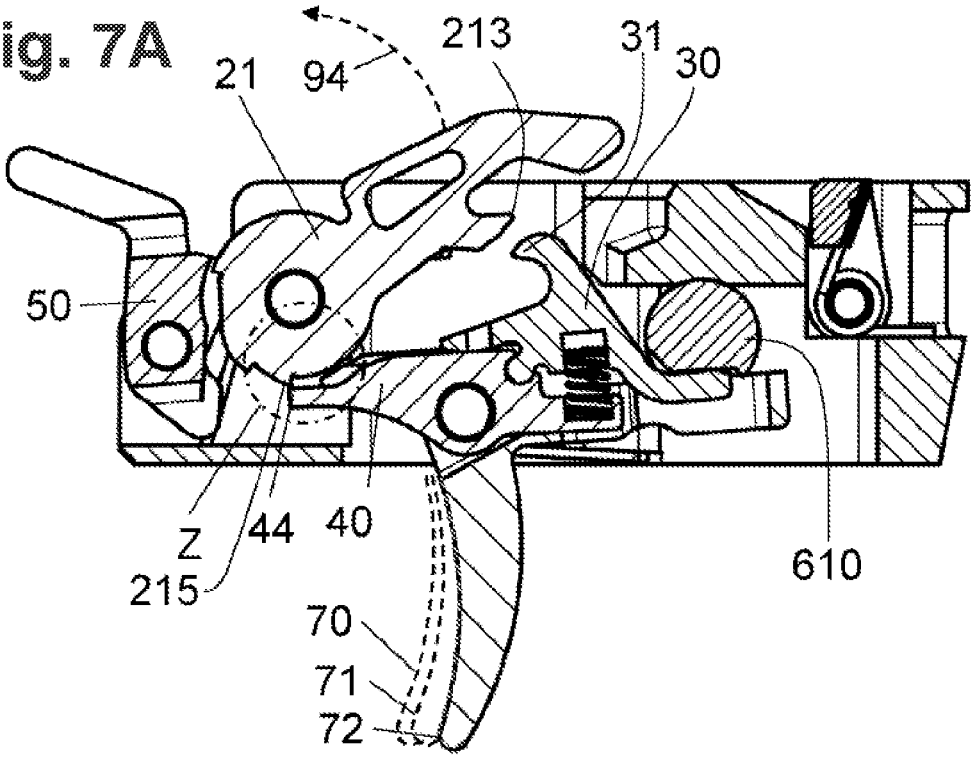
FIGS. 7A and 7B show a section view of the illustrative trigger unit in the second trigger stage position in a "single fire" configuration.

In FIG. 7A, the trigger unit 20 (FIG. 18) is shown with fire-control/safety selector 60 (variant as a rotary selector 610) in the single fire position in the second trigger stage position 72. The rotary selector 610 is in the single fire position and allows the trigger lever 26 to be deflected into the second trigger stage position 72. The sear edge 44 of the sear 40 releases the path of movement of the hammer 21 including its hammer cam 215 (see in comparison FIG. 10C), it thus performs a rotary movement of the hammer 21 in the hammer upward/forward rotating direction 94, indicated by a dashed arrow, under the action of the hammer spring 211, and hits, when installed in the weapon, on the firing pin (not shown).

Figure 7B:
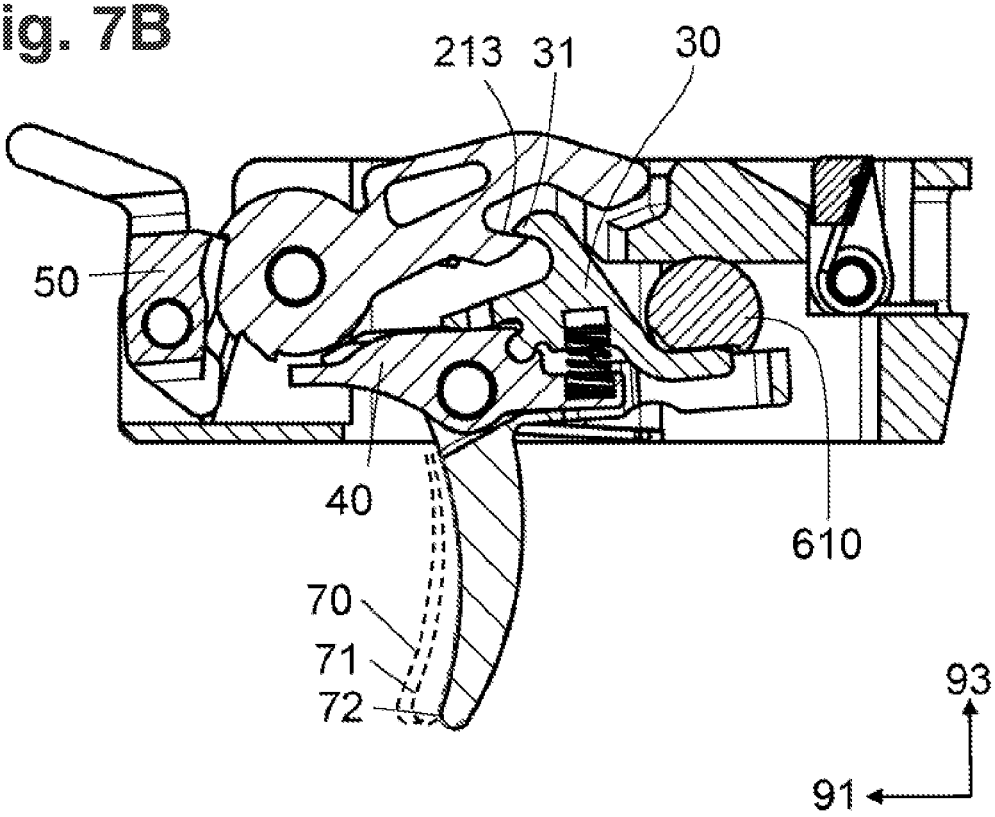

FIG. 7B shows the situation after the shot has been fired, analogous to FIG. 7A: After the shot has been fired, the bolt carrier (not shown) moves backward and tensions the hammer 21 in the process. As is common in the prior art, a disconnector hook 31 of the disconnector 30 is designed in such a way that the hammer hook 213 presses the disconnector hook 31 with the disconnector 30 to the rear during tensioning, wherein the disconnector 30 is rotated slightly about the disconnector axis 35 (FIG. 2). The disconnector spring 34 (FIGS. 2 and 3A) is (further) compressed and brings the disconnector 30 back into its original position as soon as the hammer hook 213 has passed the disconnector hook 31. The disconnector 30 with the disconnector hook 31 now catches the hammer 21, which is biased by the hammer spring 211 and pushes forward again, on the hammer hook 213 and prevents further movement of the hammer 21.

A detailed view of the area Z of FIG. 7A is shown in FIG. 10C, wherein it also is clearly visible that the safety pin 266 in the second trigger stage position 72 releases the movement path of the safety cam 216 (as already described above).

Figure 8A:
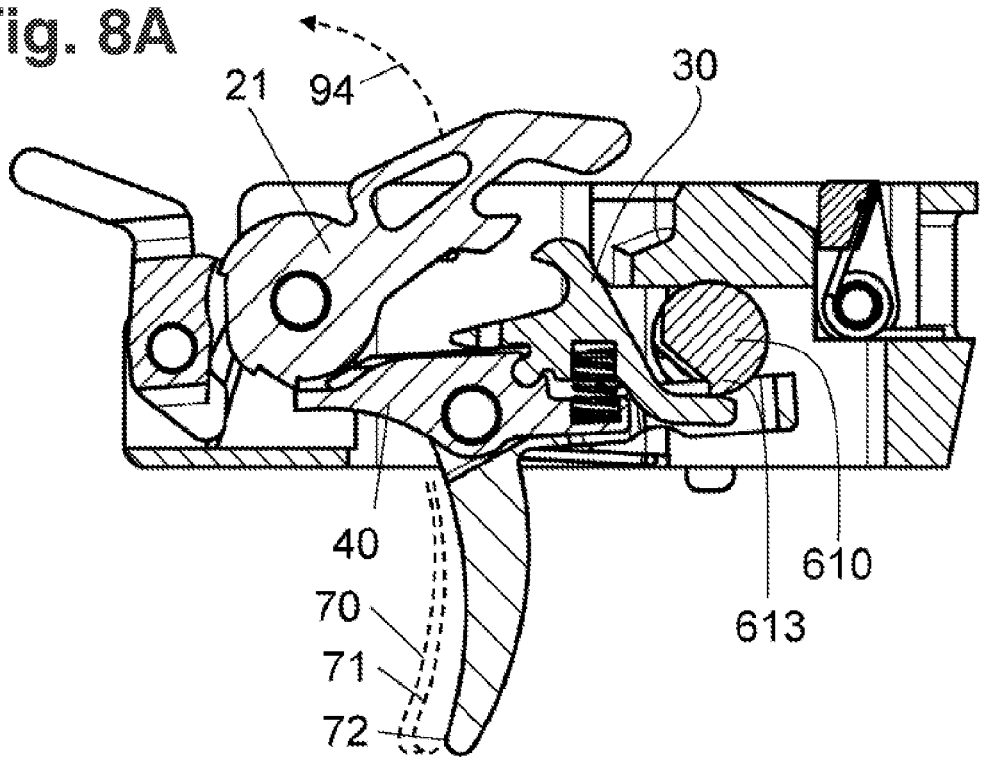
FIGS. 8A and 8B show a section view of the illustrative trigger unit in the second trigger stage position in "continuous fire" configuration.
Figure 8B:
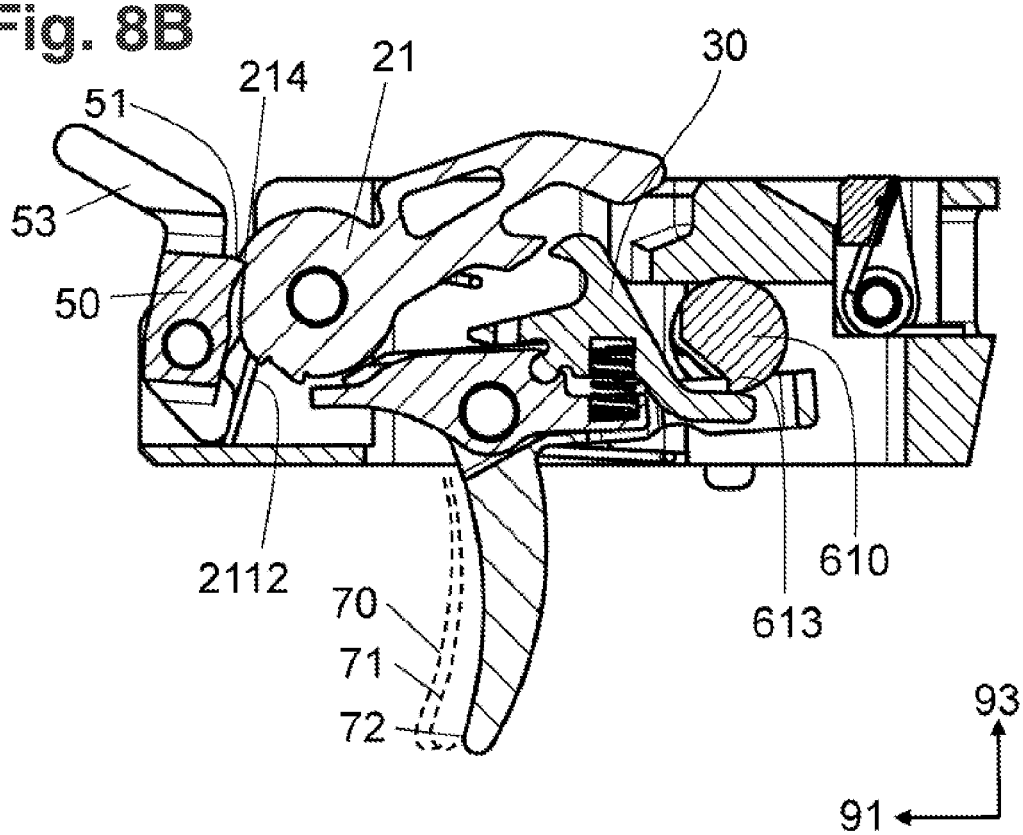

FIG. 8A shows a particular embodiment of the trigger unit 20 (FIG. 18) in the continuous fire position in the second trigger stage position 72. The rotary selector 610 is set in such a way that the stud 613 presses the back end 33 (FIG. 3A) of the disconnector 30 downward so that it lies at least partially within the correspondingly shaped trigger rear 263. As a result, the disconnector 30 is rotated about the disconnector axis 35, as a result of which the disconnector hook 31 is no longer in the path of movement of the hammer 21, and, in particular, of the hammer hook 213.

FIG. 8B shows the trigger unit 20 (FIG. 18) in the continuous fire position in the second trigger stage position 72, wherein the movement of the hammer 21 is blocked by the auto sear 50 until a bolt carrier (not shown) presses the auto sear 50 at the top 53 downward when it advances into the locked state. As soon as the shot breaks and the slide is moved backward for automatic reloading, a special shape of the slide, for example in the form of a corresponding notch on the underside of the slide, allows the auto sear 50, which is spring-loaded by the second arm 2112 of the hammer spring 211, performs a limited rotational movement about the auto sear axis 52 (FIG. 2). As a result, the auto sear edge 51 comes back into the path of movement of the hammer 21, because its auto sear hook 214 strikes the auto sear edge 51. As a result, the hammer 21 is prevented from further movement in the hammer upward/forward rotating direction 94. The bolt carrier pushes the top 53 downward again after the reloading process has ended and the breech is already in the locked state. This sequence ensures that, in the case of multiple automatic firing of shots (in continuous fire), the hammer 21 can only discharge the next shot after the breech has been completely locked.

This aspect of the present disclosure can therefore substantially be summarized as follows:

A trigger unit (20) for a firearm, comprising:

a hammer (21) rotatably mounted about a hammer axis (212) and which can be biased by means of a hammer spring (211), wherein the hammer spring (211) has a first arm (2111) and a second arm (2112), a trigger lever (26) rotatably mounted about a trigger axis (262) that has, preferably formed integrally with it, a trigger bar (264) which, when viewed in a normal direction (93), lies below the trigger axis (262) and when the trigger unit (20) is actuated by movement of the trigger bar (264) against a barrel direction (91), the trigger lever (26), having a trigger rear (263) which is designed to accommodate at least one disconnector (30)

as well as a sear (40) rotatably mounted about a sear axis (43) that can be biased by means of a sear spring (41), wherein the hammer axis (212), the trigger axis (262) and the sear axis (43) are parallel to one another and are arranged parallel to a transverse direction (92).

It is characterized in that the trigger lever (26) has a recess and the sear (40) is at least partially arranged within the recess, that the sear axis (43) and the trigger axis (262) coincide, that the sear (40) has a bearing (42) on its upper side for receiving and limiting rotation about a disconnector axis (35) of a disconnector joint (32) formed on the underside of the disconnector (30), and that the bearing (42) of the sear (40) is designed to enclose the disconnector joint (32) at least partially in the direction of rotation about the disconnector axis (35).

In one embodiment it is provided that a limiter (660) is arranged in the trigger unit (20) and is rotatably mounted about a locking lever axis (641) parallel to the transverse direction (92) and is biased by a locking lever spring (630).

In a further embodiment with a rest position (70) and three trigger stage positions (71, 72, 73) for the trigger lever (26), it is provided that in the trigger unit (20) a rocker lever (45) is arranged around a rocker axis (456), when viewed in the barrel direction (91), in front of the trigger axis (262), that the rocker lever (45) has a first end (451) and a second end (452) that in the third trigger stage position (73) the first end (451) of the rocker lever (45) is pressed downward by the sear (40), when viewed in the normal direction (93), and the rocker lever (45) is rotated about the rocker axis (456), and that the second end (452) of the rocker lever (45) protrudes upward in the third trigger stage position (73) and moves the disconnector (30) upward on a finger (36), when viewed in the normal direction (93), and rotates it around the disconnector axis (35).

In a further development, it is provided that the sear (40) has a sear opening (47) arranged in front of the disconnector axis (35) for the second end (452) of the rocker lever (45) to reach through, when viewed in the barrel direction (91).

Another development provides that in the trigger unit (20) an auto sear (50), biased by the hammer spring (211) and rotatably mounted about an auto sear axis (52), when viewed in the barrel direction (91), is arranged in front of the hammer axis (212).

In yet another further development, a spring seat (55) for supporting the second arm (2112) of the hammer spring (211) is formed on the auto sear (50), when viewed in the normal direction (93), below the auto sear axis (52).

In an advantageous further development it is provided that the first arm (2111) of the hammer spring (211) is supported on the hammer spring support (261) of the trigger lever (26), and the second arm (2112) of the hammer spring (211) supported on the spring seat (55) of the auto sear (50).

In yet another further development, it is provided that a hammer spring support (261) for supporting the hammer spring (211) is formed on the trigger lever (26) in the transverse direction (92).

In an advantageous embodiment it is provided that the disconnector (30), when viewed in the normal direction (93), has a spring recess (46) on its underside for at least partial accommodation of a disconnector spring (34).

In a further development it is provided that the spring recess (46) is at least partially open when viewed laterally in at least one transverse direction (92).

In a further development of this embodiment it is provided that the spring recess (46) has an outwardly sloping ramp (461) when viewed in the transverse direction (92).

Another further development of the basic idea provides that at least one spur (266) extending from the trigger axis (262) in the barrel direction (91) is formed on the trigger lever (26) and a spur (266) is formed on the hammer (21) in the area of the hammer axis (212), and that the spur (266) protrudes in the rest position (70) and when in the first trigger stage position (71), into a movement path of the safety cam (216) of the hammer (21).

Another development provides that a back end (33) is formed on the disconnector (30) and in the second trigger stage position (72) a stud (613) of a rotary selector (610) presses down against the force of a disconnector spring (34).

In one embodiment it is provided that the trigger unit (20) is accommodated in a trigger housing (23) which is preferably designed as a modular drop-in unit.

Finally, the present disclosure includes a firearm which has a trigger unit (20) with the features defined above.

Pull-Through Trigger

Figure 14:
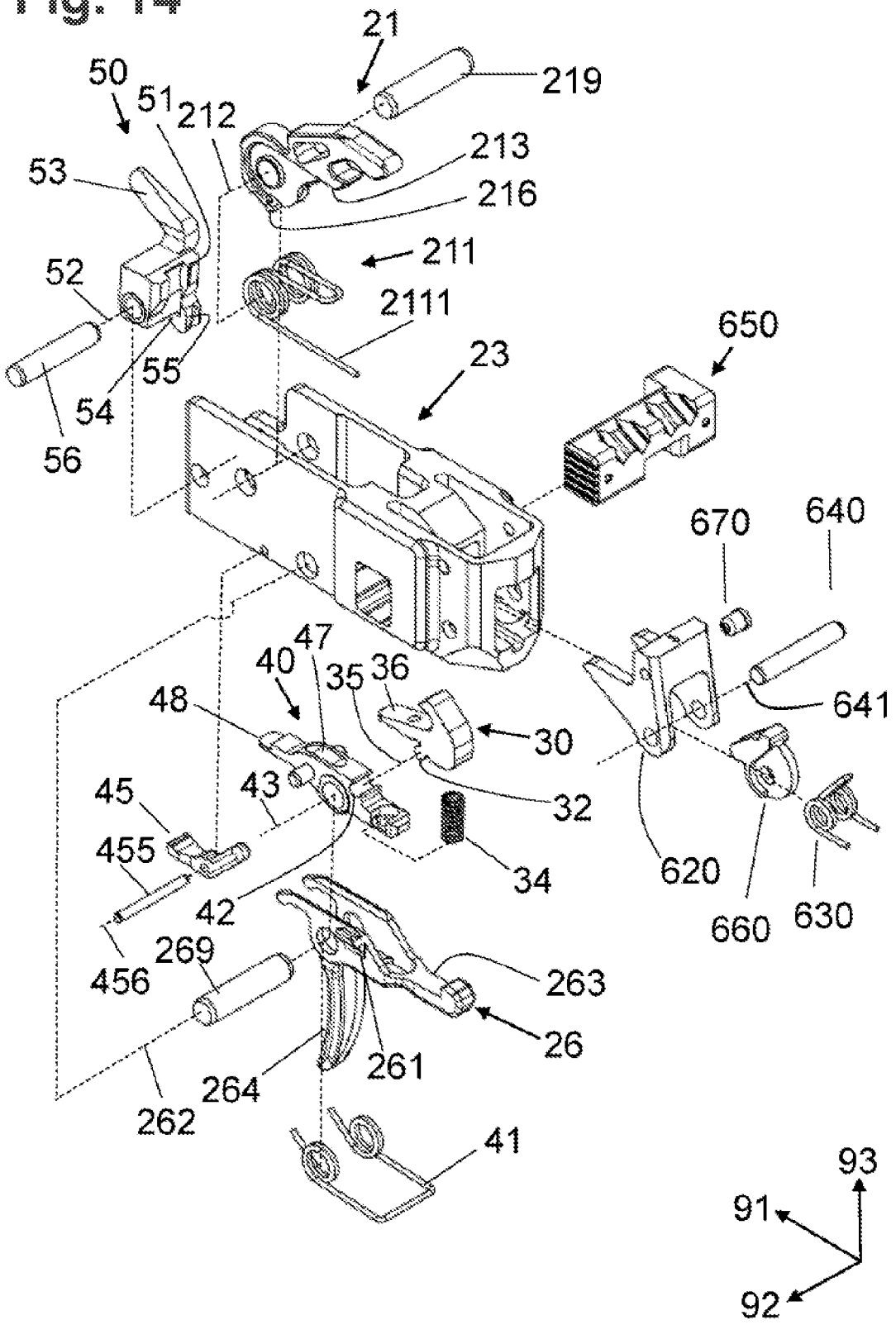
FIG. 14 shows a simplified exploded view of an alternative and illustrative embodiment of the trigger unit as a "pull-through" trigger unit from the rear.

As previously described above, the trigger according to the present disclosure can also be designed in three stages as a pull-through trigger. As already explained, with a pull-through trigger, continuous fire can be achieved by pulling the trigger bar 264 all the way through the second trigger stage position 72 into a third trigger stage position 73, possibly without changing the position of the fire-control/safety selector 60. In FIG. 14, similar to FIG. 2, such a pull-through trigger is shown in a preferred embodiment as a trigger unit 20 with a trigger housing 23 as an exploded view.

The pull-through variant comprises, like the two-stage trigger described above with reference to FIGS. 2-10, a hammer 21, a trigger lever 26, a sear 40, a disconnector 30, an auto sear 50, a fire-control/safety selector 60 and a locking lever 620, which are designed analogously in form and function as described above. The pull-through trigger can also be arranged as a trigger unit 20 in a trigger housing 23 analogously to the two-stage embodiment already described.

In a modification of the two-stage trigger described above, the illustrated embodiment of a pull-through trigger includes an additional limiter 660, which is mounted between the locking lever 620 and the locking lever spring 630 so as to be rotatable about the locking lever axis 641. Furthermore, the pull-through trigger has a rocker lever 45 which, in the embodiment shown, is rotatably supported by a dowel pin 455 about a rocker axis 456. The rocker axis 456 is arranged in front of the trigger axis 292 when viewed in the barrel direction 91. The sear 40 has a sear opening 47 through which the rocker lever 45 partially protrudes and, when viewed in the barrel direction 91, in front of it a front end 48 with an underside formed on the sear 40. No back end (compare with 33 in FIG. 3A) is provided on the disconnector 30 in this embodiment as shown in FIG. 14.

The embodiment as a pull-through trigger can be designed with a fire-control/safety selector 60, wherein the fire-control/safety selector 60 can be designed as a rotary selector 610 or a sliding selector 650. The fire-control/safety selector 60 can preferably have at least two positions ("safe" and "fire"), i.e. with the fire-control/safety selector 60 in the "fire" position the user of the firearm can fire individual shots ("single fire") by pulling the trigger bar 264 to the first trigger stage position 72, or fire multiple shots ("continuous fire") by pulling the trigger bar 264 through to the third trigger stage position 73.

However, a fire-control/safety selector 60 with, for example, three or more positions is also conceivable ("safe," "single fire" and "continuous fire," or also "burst fire"). By selecting the "single fire" position of the fire-control/safety selector 60, the trigger bar 264 cannot be pulled through into the third trigger stage position 73 and only individual shots can be fired ("single fire"). With the fire-control/safety selector 60 in the "continuous fire" position, the trigger bar 264 can be moved to the third trigger stage position 73 and multiple shots can be automatically fired.

The variant of the pull-through trigger shown has a fire-control/safety selector 60 that is a sliding selector 650 with two positions, wherein a rotary selector 610 can also be used, as described in the following and is shown in FIGS. 11 to 13. The pull-through trigger can also be used on its own. Likewise, a sliding selector 650 or a rotary selector 610 can be implemented independently with the trigger variant described above.

On the locking lever 620 for the sliding selector 650, no spike 622 is required on the locking lever arm 621; instead, the locking lever 620 preferably comprises, as shown, a spring-loaded plunger 670, which is arranged laterally in the locking lever 620 and normal to the barrel axis (in the transverse direction 92) and is connected to the locking lever 620 (for example screwed in, glued, etc.). The spring-loaded plunger 670 engages in a detent in the trigger housing 23 or in the receiver 11 of the firearm and thus holds the locking lever 620 in position.

In FIGS. 15 to 16 an embodiment of a pull-through variant of the trigger unit 20 according to the present disclosure is shown in section views along the sectional plane A-A (as in FIG. 4A) in different trigger stage positions 70, 71, 72, 73; and the details of the sliding selector 650 are shown in FIGS. 17A to 17C. The function of the individual parts can be seen by looking at them together.

Figure 15A:
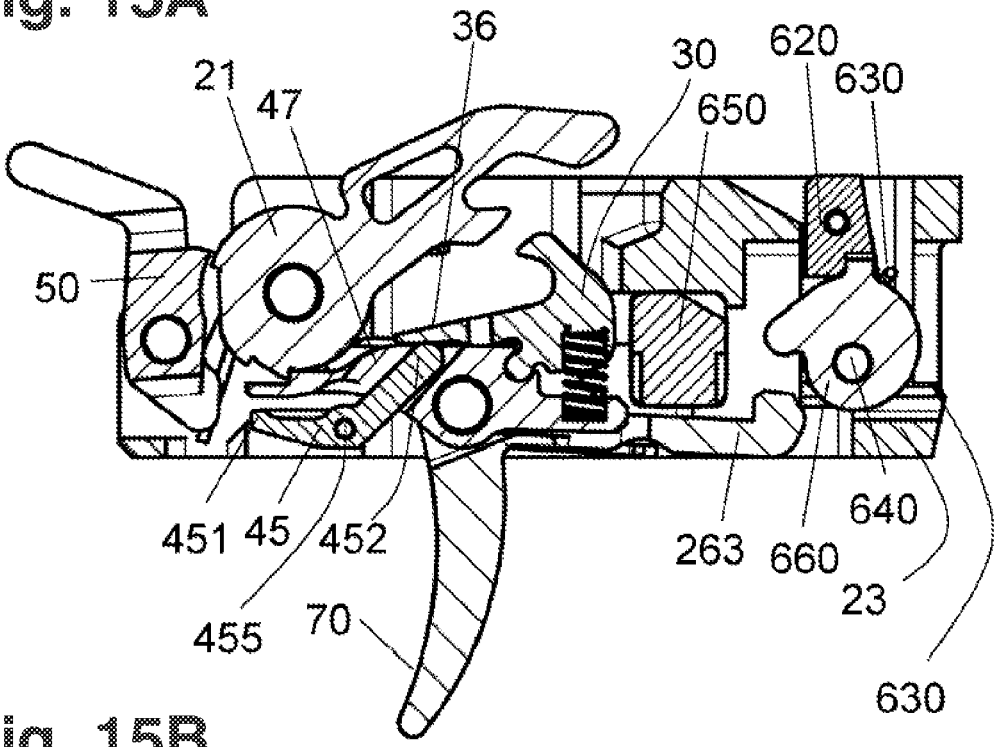
FIGS. 15A and 15B show sectional views of the trigger unit of FIG. 14 in the rest position and in the first trigger stage position.
Figure 15B:
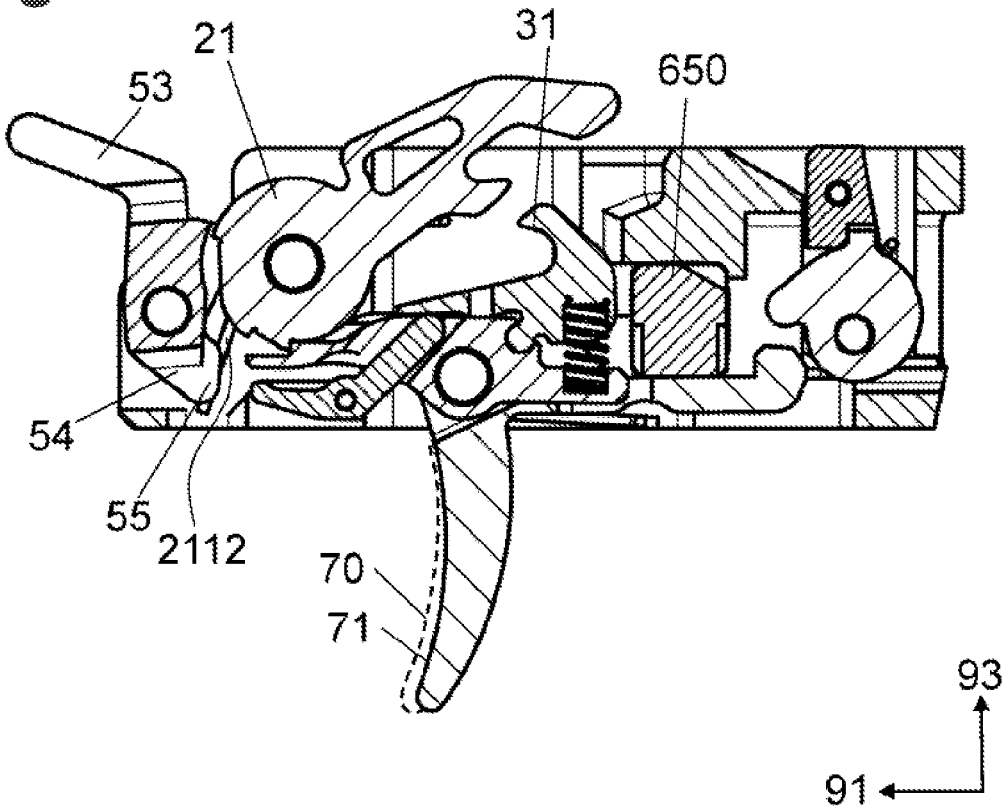

FIG. 15A shows the pull-through trigger with the trigger bar 264 in the rest position 70 with the sliding selector 650 in the "safe" position with the hammer 21 under tension from the hammer spring 211, and FIG. 15B shows the trigger bar 264 moving towards the first trigger stage position 71 (cf. FIGS. 5A and 5B). The trigger lever 26 cannot be moved any further with the sliding selector 650 in the "safe" position, since the rear part 263 of the trigger strikes the sliding selector 650. The rocker lever 45 rotatably mounted around the dowel pin 455 has a first, front end 451, and a second, rear end 452, and is substantially V-shaped in this section with an extended central angle, although other variants with the same function, such as U-shaped, or others, are also possible. The second end 452 of the dowel pin 455 protrudes obliquely upward into the sear opening 47 of the sear 40 and can touch the disconnector 30 on the finger 36.

The limiter 660, which is rotatably mounted about the locking lever axis 641, is biased by the locking lever spring 630 supported on the trigger housing 23 and is pressed counterclockwise against the locking lever 620, as shown in the illustration, and is limited thereby in its rotational movement.

Figure 16A:
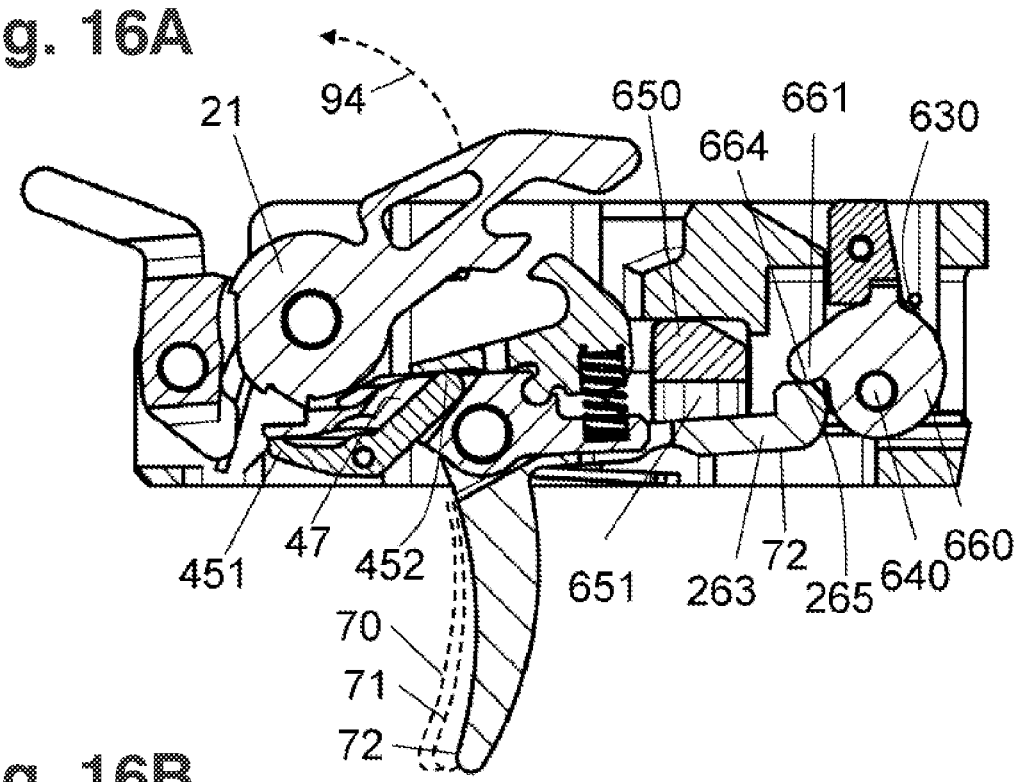
FIGS. 16A and 16B show sectional views of the trigger unit of FIG. 14 in the second and third trigger stage positions (e.g., single fire and continuous fire configurations)
Figure 17A:
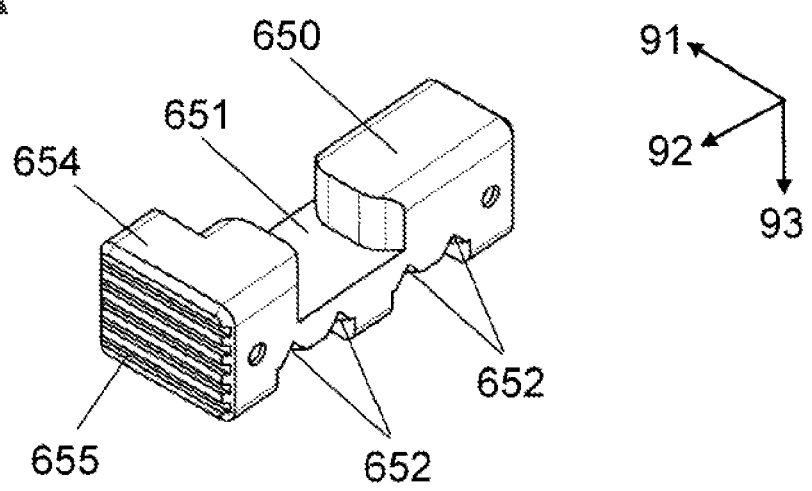
FIGS. 17A-17C show detailed views of the sliding lock of the illustrative trigger unit.
Figure 17B:
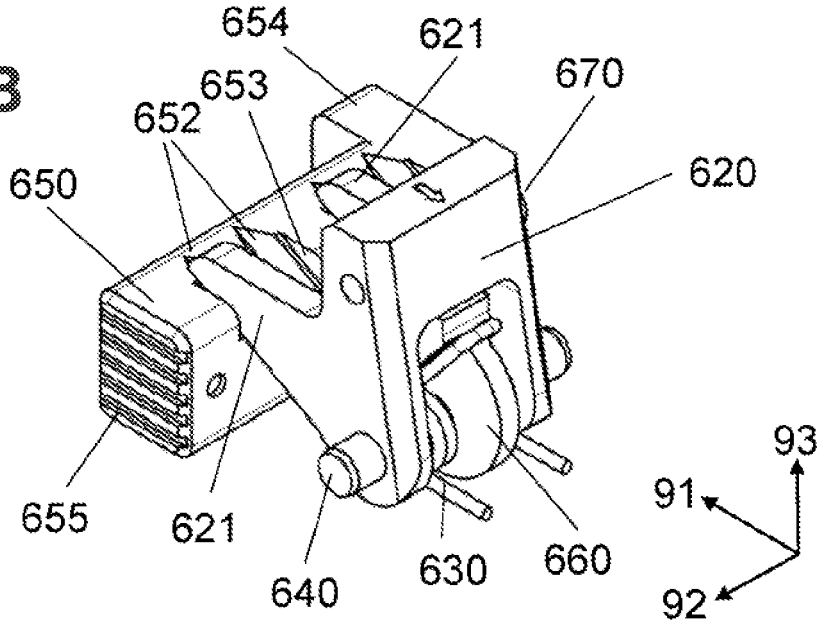
Figure 17C:
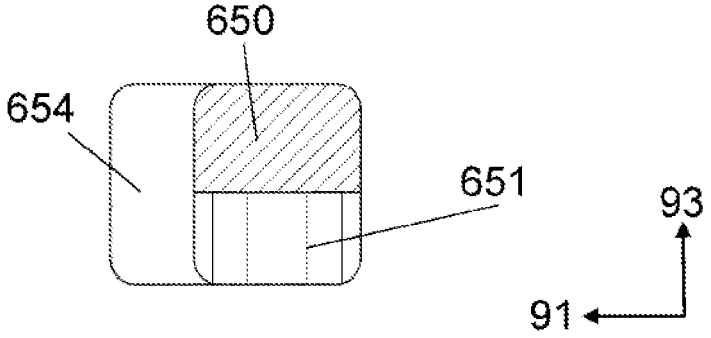

In the "fire" position, FIG. 16A, a corresponding recess 651 (cf. FIG. 17A) in the fire-control/safety selector 60, with a sliding selector 650 shown in the illustration, allows a further movement of the trigger lever 26 into the second trigger stage position 72. The movement of the trigger lever 26 is now limited by the contact surface 265 of the trigger rear 263 contacting the counter surface 664 of the projection 661 formed on the limiter 660. As already described above, in the second trigger stage position 72 the sear 40 releases the movement of the hammer 21, which rotates accordingly in the hammer rotating direction 94 (see FIG. 7A) about the hammer axis 212. Also already described in detail above (see FIG. 7B), the disconnector 30 catches the hammer 21 in its backward movement after a shot has been fired.

Figure 16B:
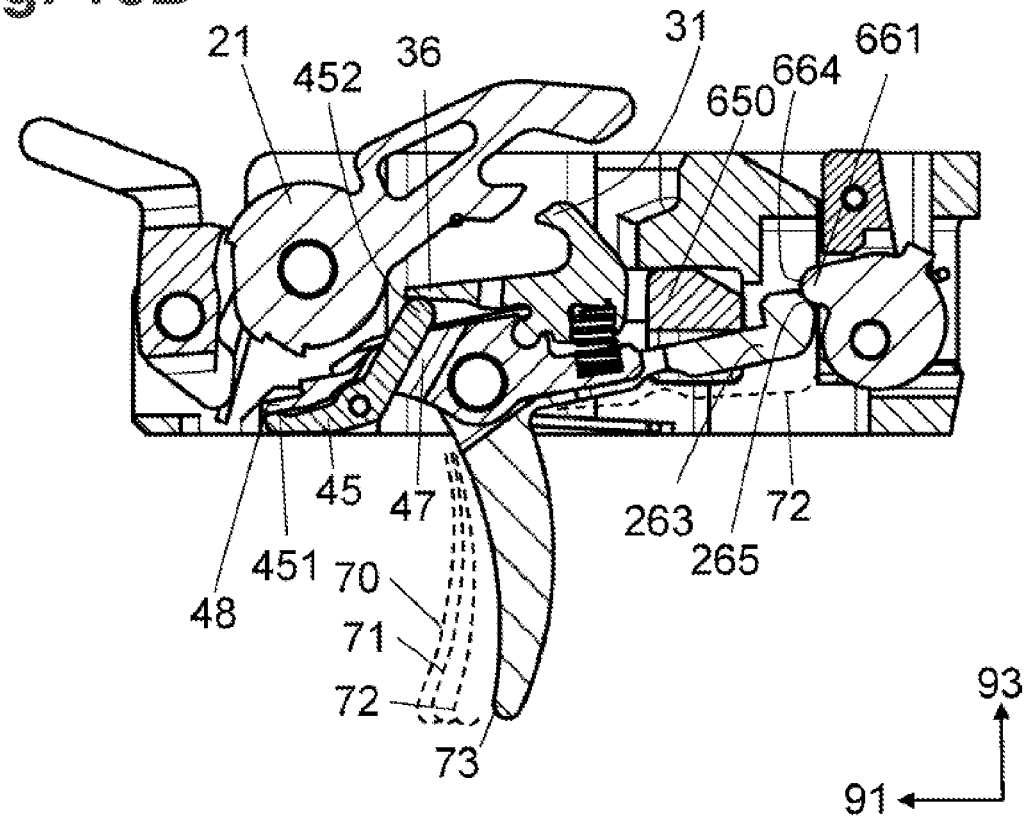

If the trigger bar 264 is now "fully pulled through" beyond the second trigger stage position 72, as shown in FIG. 16B, the third trigger stage position 73 is reached. In order to reach the third trigger stage position 73, additional force has to act on the trigger bar 264, since the projection 661 of the limiter 660 has to be moved upward from the trigger rear 263. This results in additional trigger resistance, since the limiter 660 can only be rotated against the spring preload from the locking lever spring 630 (clockwise in the illustration shown) about the locking lever axis 641 of the locking lever pin 640. The shooter will be able to clearly perceive and easily recognize a difference between single fire and continuous fire (fully drawn) while pulling the trigger bar 264 to the rearward position. Further movement of the trigger lever 26 can be limited by abutting the trigger rear 263, for example on the fire-control/safety selector 60 or on the trigger housing 23. However, it is also possible to limit the further movement of the trigger lever 26 in another way, for example by abutting the limiter 660 on the trigger housing 23.

The function of the rocker lever 45 can also be clearly seen in FIG. 16B. In the third trigger stage position 73, the first, front end 451 of the rocker lever 45 is pressed down from the underside of the front end 48 of the sear 40, which is arranged in front of the sear axis 43, and the rocker lever 45 is rotated about the rocker axis 456 and the dowel pin 455. Correspondingly, the second, rear end 452 of the rocker lever 45 moves out of the sear opening 47 and upward beyond the sear 40 and, during this movement, entrains the finger 36 of the disconnector 30 resting on the sear 40. This movement causes the disconnector 30 to rotate about the disconnector axis 35 so that the disconnector hook 31 no longer protrudes into the path of movement of the hammer 21, whereby continuous fire is possible.

It should be pointed out at this point that in addition to the illustrated embodiment of the rocker lever 45 and the sear 40 with opening 47 for the passage of the second, rear end 452 of the rocker lever 45, other functionally identical shapes can also be used and, for example, the rocker lever and the sear can be side by side, however it is essential that the second, rear end 452 presses the disconnector 30 on its finger 36 upward and away from the sear 40 when the trigger bar 264 is pulled through to the rear. Designs are also conceivable in which the sear 40 is formed integrally with the trigger lever 26.

The pull-through trigger according to the present disclosure can, as shown, comprise a fire-control/safety selector 60 that is designed, for example as a rotary selector 610 or sliding selector 650, as well as an auto sear 50 which functions as has already been described above (see FIG. 8B). However, the present disclosure is not limited to these embodiments and , for example, an auto sear arranged behind the trigger axis (such as known from firearms derived from the traditional AR-15 platform), or other embodiments can easily be designed by those skilled in the art with knowledge of the present disclosure and the envisioned field of application.

Fire-Control/Safety Selector 60

Figure 11A:
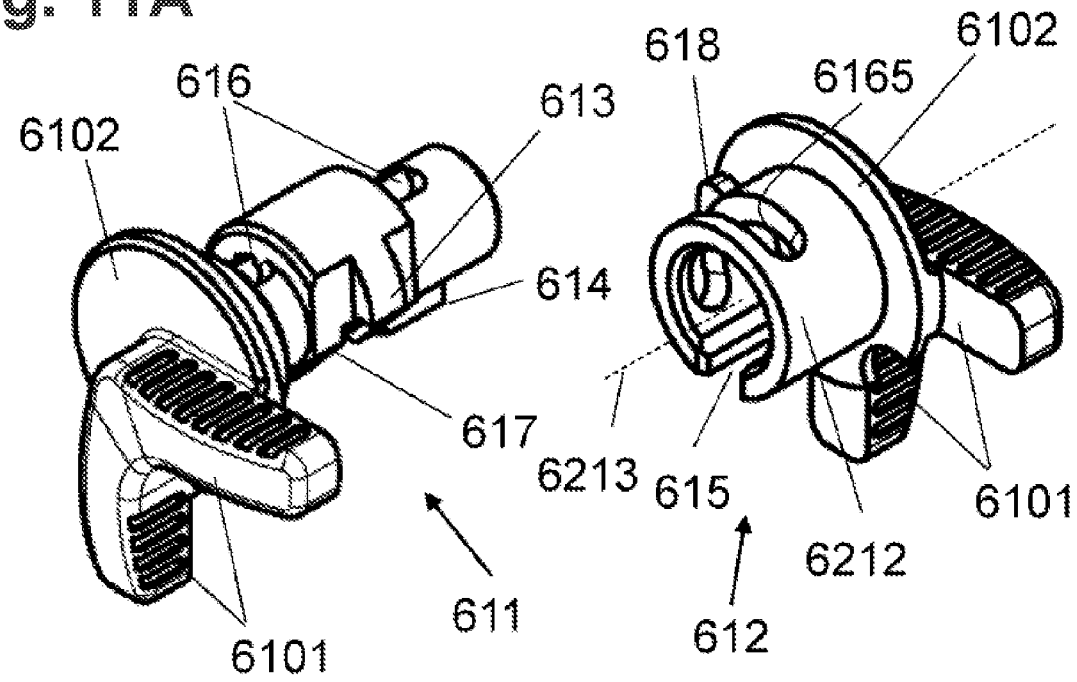
FIGS. 11A and 11B show detailed views of the rotary fire-control/safety selector of the trigger unit.
Figure 11B:
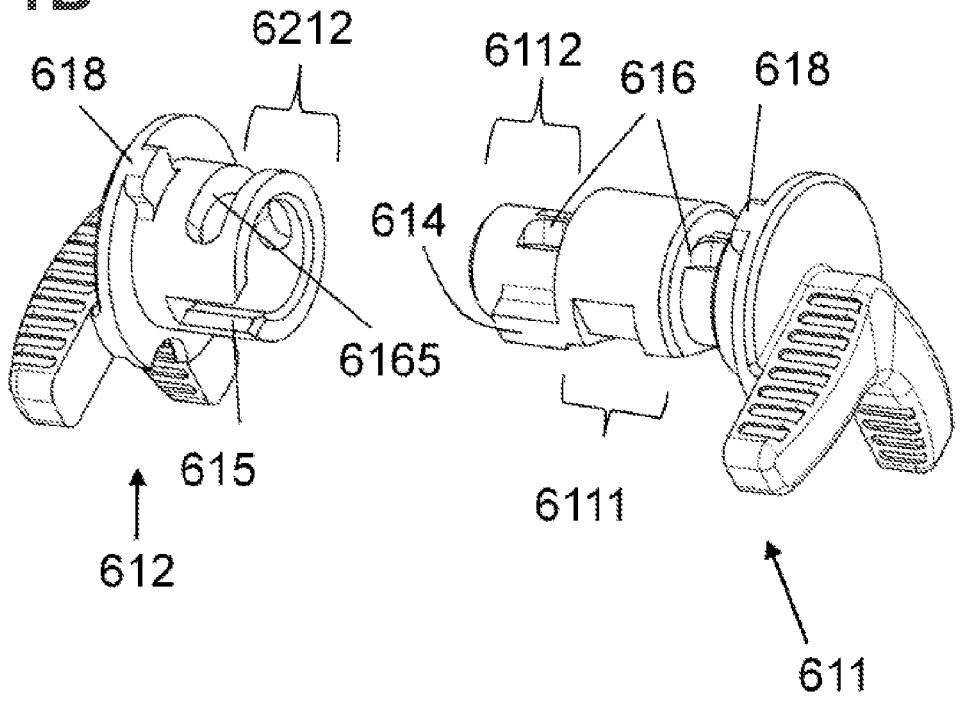

As already described above, the fire-control/safety selector 60 can be designed as a rotary selector 610. FIGS. 11A and 11B show a preferred embodiment of a rotary selector 610 having a first rotary lever 611 and a second rotary lever 612 in a perspective view from two angles. To actuate the rotary selector 610, one or more actuators 6101 can be formed on one or both of the rotary levers 611, 612, which in the installed condition are arranged outside of the trigger housing. For ease of operation, these actuators 6101 can have, or form haptically optimized (fluted, roughened, etc.), gripping surfaces. Adjacent to the actuators 6101, as shown, sealing plates 6102 can be arranged, which seal the rotary selector 610 to the outside of the trigger housing 23 in the installed condition. As shown, a stop nipple 618 and/or an indicator window 619 (FIG. 13B) for displaying the firing position can be formed on the sealing plate 6102.

As is customary in the prior art, the rotary selector 610 comprises a cam surface 617, which preferably has a stud 613. The first rotary lever 611 comprises a cylinder 6111 with a substantially cylindrical end section 6112 adjoining it, wherein the end section 6112 has a smaller outer diameter than the cylinder 6111. At least one detent (recess) 616 is formed on the end section 6112. Two detents or several detents 616 (see FIG. 11A in conjunction with FIG. 13A) are preferably arranged on a line in the circumferential direction of the cylinder 6111 and at least one rib 614 that is oriented parallel to the cylinder axis. In addition, one or more detents 616 can be arranged on a connecting piece between the sealing plate 6102 and the cylinder 6111.

In a preferred embodiment, the first rotary lever 611 can also have further detents 616 on the cylinder 6111 adjacent to the cam surface 617, which are arranged on a line in the circumferential direction. These further detents 616 can be arranged, for example, between the cam surface 617 and the actuator 6101. Each of the detents 616 formed on a line lying in the circumferential direction corresponds to a corresponding fire selection position (with two notches for "safe" and "fire," or with three notches for "safe," "fire" and "continuous fire"). These characteristics apply mutatis mutandis to the eventual formation of a "burst fire" position.

The second rotary lever 612 comprises a hollow cylinder 6212 with a hollow cylinder axis 6213 which has at least one selector slot 6165 running in the circumferential direction and a continuous notch 615 running parallel to the cylinder axis 6213. The inside diameter of the hollow cylinder 6212 corresponds to the outside diameter of the end section 6112, and the outside diameter of the hollow cylinder 6212 corresponds to the outside diameter of the middle section of the cylinder 6111. The end section 6112 with the rib 614 is designed to complement the shape of the hollow cylinder 6212 with the continuous notch 615 and allows the end section 6112 to be pushed into the hollow cylinder 6212. The continuous notch 615 receives the rib 614 and the selector slot 6165 is arranged above the detents 616 on the end section 6112, whereby the detent 616 remains accessible from the outside. The detents 616 and the selector slot 6165 above appear like a notch with detents 616 and act accordingly.

In the installed condition, the first and second rotary levers 611, 612 are connected to one another in such a way that they are non-rotatable and a common rotation about the cylinder axis 6213 through one-sided operation is possible. In the installed condition, the rotary selector 610 is secured by the engagement of the locking lever 620 with the locking lever arm 621 and spike 622, whereby the rotary selector 610 is protected against being pulled apart or unintentionally falling apart—see also FIG. 13A.

Figure 12A:
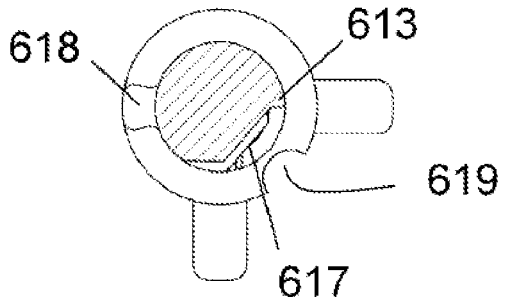
FIGS. 12A-12D show detailed views of the rotary fire-control/safety selector in cross sections and the bore in the trigger housing for the fire-control/safety selector.
Figure 12B:
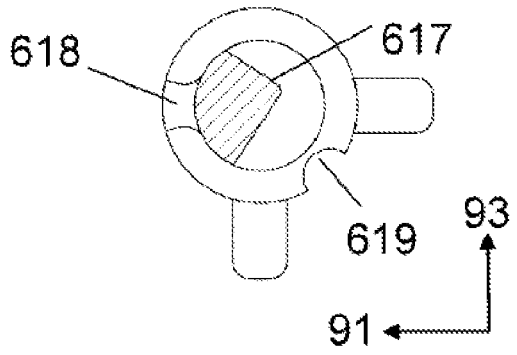

In FIGS. 12A and 12B a cross section of an embodiment of a rotary selector 610 along the line in the section plane A-A (as in FIG. 4A) is shown in the viewing direction to the front. FIG. 12A shows a rotary selector 610 with three positions (three-part cam surface 617 with stud 613 for "safe," "fire" and "continuous fire"). FIG. 12B shows a rotary selector 610 with two positions (two-part cam surface 617 for "safe" and "fire"), as it can be implemented, for example, in the pull-through trigger variant described below or for variants that do not allow continuous fire.

Figure 12C:
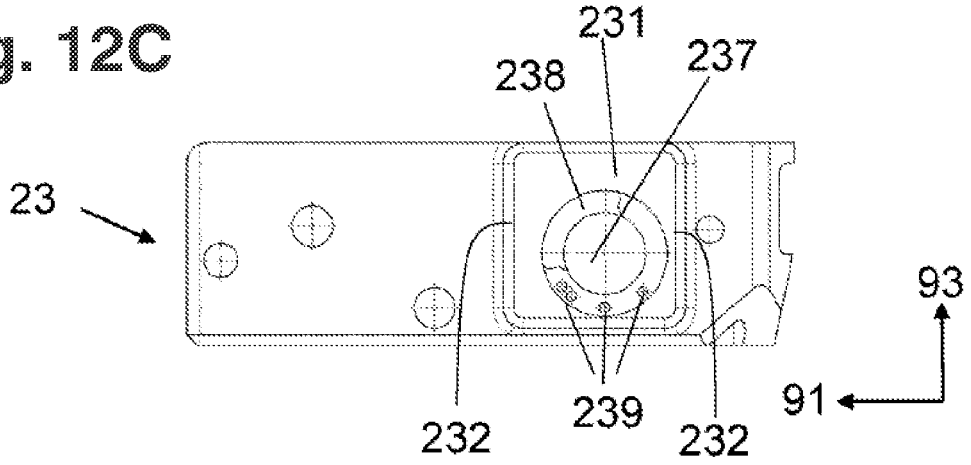
Figure 12D:
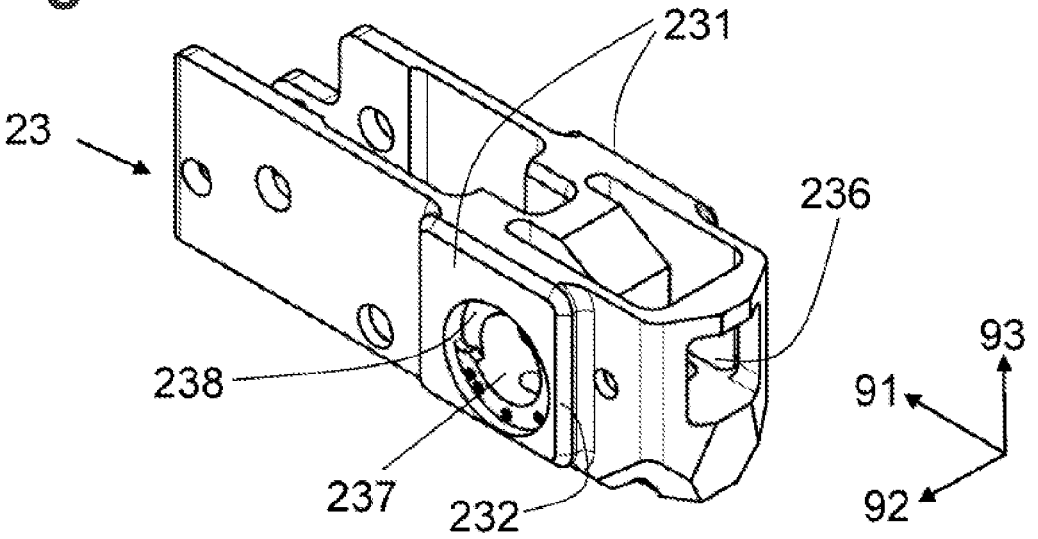

FIG. 12C shows a trigger housing 23 in a side plan view. FIG. 12D shows the trigger housing 23 in a perspective view. The selector hole 237 accommodates the fire-control/safety selector 60 or, in the embodiment shown, the cylinder 6111 and the hollow cylinder 6212 of a rotary selector 610. In the illustration shown, a selector cam 238 and an indicator 239 are also provided. The locking lever recess 236 serves to receive the locking lever 620 and the locking lever spring 630, which is supported on the trigger housing 23, and, in the pull-through trigger described above, to also accommodate a limiter 660 (FIG. 14). In the installed condition, the indicator 239 is largely covered by the sealing plate 6102 of the rotary selector 610, but the respectively selected firing position of the indicator 239 remains visible to the user through the indicator window 619 (FIG. 13B). In the installed condition, a stop nipple 618 (FIG. 13B) of the rotary selector 610 lies in the selector cam 238 and limits the possible rotational movement of the rotary selector 610 in the circumferential direction.

Figure 13A:
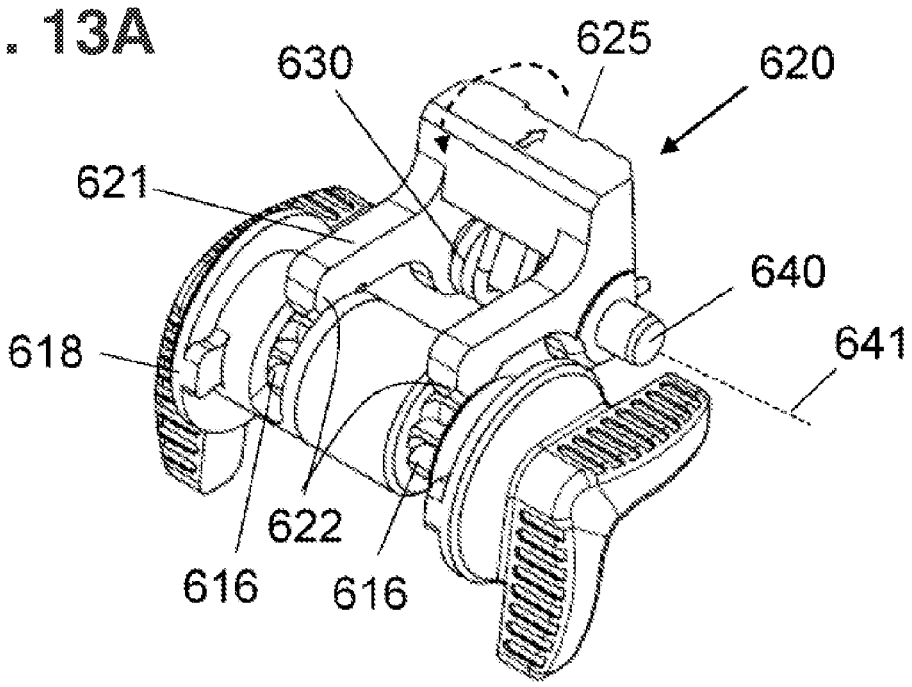
FIGS. 13A and 13B show detailed views of the rotary fire-control/safety selector in the installed condition.
Figure 13B:
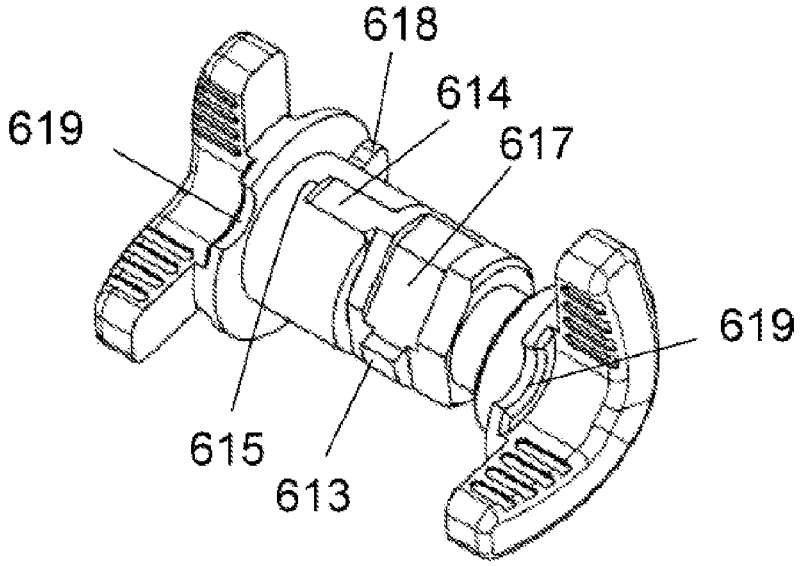

FIG. 13A shows a preferred embodiment of the rotary selector 610 in the installed condition with the locking lever 620, wherein the trigger housing 23 is not shown for better visibility. The locking lever 620 is mounted rotatably about a locking lever axis 641 of the locking lever pin 640 and is biased by the locking lever spring 630, wherein the locking lever spring 630 is supported in the trigger housing 23 and on the locking lever body 625. The locking lever 620 is thus biased counterclockwise around the locking lever pin 640 (within the locking lever axis 641) acting as the axis of rotation in the direction of the movement arrow in FIG. 13A. At least one spike 622 is formed on the locking lever arm 621, which protrudes through the selector slot 6165 and engages in a detent 616 of the end section 6112. In this way, the two rotary levers 611, 612 can no longer be displaced in the direction of the cylinder axis (not even relative to one another).

In the installed condition, a firing position is selected by turning the rotary selector 610. The locking lever 620 is pressed backward against its spring preload, so that the spike 622 is pressed out of a detent 616 and, upon further rotation, is pressed into the next detent 616 by the spring force of the locking lever spring 630. The spike 622 protrudes into selector slot 6165 at all times during this rotary movement, which prevents the two rotary levers 611, 612 from being pulled apart or inadvertently falling apart.

Only by actively pushing the locking lever body 625 backward can the locking lever arm 621 with the spike 622 be turned upward so far that the spike 622 no longer protrudes into the selector slot 6165, whereby the two rotary levers 611, 612 can be pulled apart. This allows the rotary selector 610 to be dismantled or replaced without tools. It is also possible to easily swap a rotary selector 610 with three positions for a rotary selector 610 with two positions (e.g. without the "continuous fire" position). This special version of a rotary selector 610 with locking lever 620 may represent an invention of its own.

It is also easily feasible for a person skilled in the art, with knowledge of the present disclosure, to use the inventive rotary selector 610 (even without connection to the locking lever 620) in a slightly modified embodiment trigger systems other than the systems described herein, such as the triggers utilized in firearms based on the traditional AR-15 platform. The spring-loaded pressure pin that is typically arranged in the grip and lower receiver of firearms based on the traditional AR-15 platform would now engage the rotary selector 610 and secure it in place, instead of the spike 622 through the selector slot 6165 in the detent 616 as detailed above.

Details of the sliding selector 650 proposed in one embodiment of the present disclosure are shown in FIGS. 17A to 17C, with the directional arrows indicating the orientation of the view in each case. The sliding selector 650 has an elongated, approximately cuboid shape with a cross section that is substantially the same over most of the length, and the selector opening 273 is also correspondingly complementary in shape. In the example shown, the cross section is rectangular, but round, oval, square and other cross sections are also possible. On the two longitudinal ends, push portions 655 for operating the sliding selector 650 (displacement in or against the transverse direction 92) are formed. At one end, as shown, a top 654 may be formed which has an enlarged cross section. At least one recess 651 is formed on the underside of the sliding selector 650 facing the trigger lever 26 (clearly visible in FIG. 17A as a view from below), which releases the movement of the trigger lever 26 into second trigger stage position 72 and/or the third trigger stage position 73 with a corresponding position of the sliding selector 650. In a further embodiment, the recess 651 can also be designed in two stages or in multiple stages in order to enable a sliding selector 650 with three (or more) positions.

At least one pair of parallel and mutually merging grooves 652, which serve as detent positions for the locking lever 620, is formed on the outer contour of the sliding selector 650 facing the locking lever 620. In the installed condition, the sliding selector 650 is preferably arranged in its longitudinal direction normal to the barrel direction 91 in the transverse direction 92, whereby the grooves 652 are formed substantially parallel to the barrel direction 91 or parallel to the center plane of the weapon. In the installed condition, the sliding selector 650 can protrude with both ends over the firearm's receiver 11 or—depending on the position—end flush with the receiver 11 on one side. In principle, it is also conceivable that one end lies in at least one position within the receiver 11.

FIG. 17B shows the sliding selector 650 in the installed condition with the locking lever 620, locking lever spring 630 and limiter 660 and without the trigger housing 23 for better visibility. In the particular embodiment shown, two pairs of grooves 652 merging into one another are formed on the outer contour of the sliding selector 650. In a preferred embodiment, the grooves 652 are elongated and V-shaped and merge, for example, in a U-shape (or with a rounding or an inclined transition surface) to thus form a continuous, contoured depression in the surface of the sliding selector 650. The locking lever 620 and limiter 660 are rotatably mounted around the locking lever pin 640. The locking lever spring 630 is supported on the trigger housing 23 (not shown) and biases the limiter 660. The limiter 660 in turn rests on the locking lever 620, whereby the locking lever 620 is also spring-biased. Correspondingly, a locking lever arm 621 formed on the locking lever 620 (two locking lever arms 621 can be seen in the embodiment shown) is pressed into a groove 652 and thus holds the sliding selector 650 in position.

If the sliding selector 650 is now shifted in the transverse direction 92 (in the position shown in the direction of the second groove 652 of the pair of grooves) by pressing on the push portion 655, the locking lever arm 621 is pressed against the spring preload thereby making it possible to shift the sliding selector 650 from the first firing position to the second firing position. As a result of the spring preload, the locking lever 620 engages in the second groove 652 of the pair of grooves after the second firing position has been reached.

Each groove 652 of a groove pair has a stop 653 on the side facing the other groove 652, so that further displacement of the sliding selector 650 is limited by the locking lever arm 621 contacting the stop 653 (FIG. 17B). In this way, the sliding selector 650 is secured against being pulled apart or inadvertently falling apart.

As shown, a spring-loaded plunger 670 can be arranged on one side of the locking lever 620 so that it interacts in a locking position on the inside of the trigger housing 23 and thus holds the locking lever 620 in position. The locking lever 620 will be held in position even if, for example, the trigger is pulled through to the trigger stage position 73, because the limiter 660 is pressed backward against its spring preload and thus already releases a movement of the locking lever 620. As a variant, it is also possible to arrange a further spring between the limiter 660 and the locking lever 620.

In addition to FIGS. 17A and 17B, FIG. 17C shows a cross section of a sliding selector 650 analogous to the section plane A-A in FIG. 4A.

As already described, the fire-control/safety selector 60 can be exchanged easily and without tools using the locking lever 620 according to the present disclosure. The locking lever 620 only has to be pushed back against its spring preload to release the detent 616 (in the case of a rotary selector 610), or the groove 252 (in the case of a sliding selector 650), and thus the fire-control/safety selector 60. A rotary selector 610 with three positions can easily be exchanged for a rotary selector 610 with two positions and vice versa. Likewise, a sliding selector 650 with two positions can easily be exchanged for one with three positions (and vice versa). If the cross-sectional shapes of the rotary and sliding selectors 610, 650 are appropriately selected and the selector opening 237 is appropriately shaped, it is also conceivable to exchange a rotary selector 610 for a sliding selector 650. For example, the sliding selector 650 can be round and have the same diameter as the cylinder 6111 of the rotary selector 610; the interaction of the locking lever 620 with the detent 616 prevents a round shaped sliding selector 650 from turning.

However, a round shaped sliding selector 650 with an external longitudinal rib is also conceivable, which acts as a rotary selector with a corresponding longitudinal groove in the selector opening 237. Other forms of a selector opening 237 are also possible, which can accommodate both a rotary selector 610 and a sliding selector 650 with different cross sections.

The described sliding selector 650 according to the present disclosure can also be used with triggers other than those described herein, including those known from the prior art, and it is not limited to the examples shown.

The pull-through trigger shown in FIGS. 14-16, is possible as a variant with a rotary selector 610 according to the description above, as the two-stage trigger shown in FIGS. 2-8 can also be executed with a sliding selector 650. Principally, it has to be stated that, the number and possibilities of combinations of the individual embodiments described are not limited to the variants shown and described. Further, it is no problem for the person skilled in the art and knowing the present disclosure to combine a detail of a first variant with one or more details of another variant or variants without sticking to (the) other details of the first variant. Free combinations of all details per se are possible without being mentioned here.

The trigger described above can be designed in two stages or as a three-stage pull-through trigger. In each case, an embodiment with a fire-control/safety selector 60, which is designed as a rotary selector 610 or a sliding selector 650, is possible, wherein the fire-control/safety selector 60 can each have two or three fire positions.

According to the above statements, it is easily possible for a person skilled in the art to implement variants of the trigger according to the present disclosure without a continuous fire function, in which, for example, the limiter 660 or the stud 613 are omitted.

This aspect of the present disclosure can therefore substantially be summarized as follows:

The present disclosure relates to a trigger unit (20) for a firearm comprising a trigger lever (26) mounted rotatably about a trigger axis (262) which, preferably formed integrally with it, has a trigger bar (264) which, viewed in a normal direction (93), lies below the trigger axis (262) and when the trigger unit (20) is actuated when the trigger bar (264) is moved against a barrel direction (91), and a fire-control/safety selector (60) for selecting at least one "safe" and one "fire" position. It is characterized in that a locking lever (620) rotatably mounted about a locking lever axis (641) is arranged in the trigger unit (20) and is biased in the circumferential direction by a locking lever spring (630), and that the locking lever axis (641), considered in the barrel direction (91), is arranged behind the trigger axis (262), and the locking lever (620) is designed for releasably fixing the fire-control/safety selector (60) in a selectable position.

In a further development it is provided that the fire-control/safety selector (60) is designed as a rotary selector (610) which is rotatably mounted about an axis parallel to the normal direction (93) and comprises a first rotary lever (611) and a second rotary lever (612), a. that a cylinder (6111) with an end section (6112) is formed on the first rotary lever (611),
b. that the end section (6112) has a smaller diameter than the cylinder (6111) in the region outside the end section (6112) in the assembled state,
c. that at least one detent (616), preferably in the form of a radial recess, is arranged on the end section (6112),
d. that a hollow cylinder (6212) having a selector slot (6165) extending in the circumferential direction and a continuous notch (615) extending in the direction of a hollow cylinder axis (6213) of the hollow cylinder (6212) is formed on the second rotary lever (612),
e. that the inner diameter of the hollow cylinder (6212) corresponds to the diameter of the end section (6112),
f. that a rib (614) in the form of a radial elevation is formed on the end section (6112),
g. that the continuous notch (615) and the end section (6212) are designed to be complementary in shape to the rib (614) and to the end section (6112), and
h. that the end section (6112) can be inserted axially and displaceably into the hollow cylinder (6212).

In one embodiment, it is provided that in the installation situation in a firearm having a locking lever (620), the two rotary levers (611, 612) of the rotary selector (610), by engaging a spike (622) of the locking lever (620) in the selector slot (6165), are secured against axially moving apart, and that the rotary selector (610) is secured in this way in the trigger housing (23).

The basic idea can advantageously be further developed in such a way that the fire-control/safety selector (60) is designed as a sliding selector (650) which is mounted displaceably along an axis parallel to the normal direction (93), and a. that the sliding selector (650) has at least one pair of grooves (652) merging into one another on the outer contour, which serve as detents for the locking lever (620) and
b. that in the installed condition projections of the spring-loaded locking lever (620) protrude into the grooves (652), so that the position of the sliding selector (650) in the trigger housing (23) is secured.

This configuration can be further developed by the sliding selector (650) having an outer contour with which it is displaceably guided in at least one opening of complementary shape in a trigger housing (23) or in the receiver (11, 111, 112) of the firearm.

The basic idea can advantageously be further developed so that the locking lever (620) comprises on one side a push portion (670) which is oriented in the transverse direction (92) and which, when installed, engages in a detent in a trigger housing (23) or in the receiver (111, 112) of the firearm.

This configuration can be further developed by the trigger housing (23) having the opening of complementary shape in which the sliding selector (650) is displaceably guided.

The basic idea can advantageously be further developed so that the trigger unit (20) is housed in a trigger housing (23), which is preferably designed as a modular drop-in unit.

The present disclosure also comprises a firearm which has one of the trigger units (20) defined above.

Modular Drop-In Trigger Unit 20

Another possible embodiment of the trigger according to the present disclosure is shown in FIGS. 18 and 19. As already described, the trigger can preferably be arranged as a trigger unit 20 in a trigger housing 23. A configuration of the present disclosure that is designed as a modular drop-in trigger unit 20 can be particularly advantageous.

FIG. 18 shows a section of the lower receiver 112 of a firearm with a specially shaped receptacle for a modular drop-in trigger unit 20, which is referred to below as the trigger pocket 12. The trigger pocket 12 has a complementary shape to the modular drop-in trigger unit 20, and accommodates it completely in the lower receiver 112, with the trigger bar 264 protruding downward from the lower receiver 112. In this context, complete accommodation is to be understood as meaning that the drop-in trigger unit 20 is arranged laterally and/or in the barrel direction 91 and underneath in the installed condition so that it is fixed, but detachable. This can be ensured in a relatively simple manner by a person skilled in the art by choosing appropriate fits and/or the choice of material for the lower receiver 112 and the trigger housing 23. It has proven to be particularly advantageous if the lower receiver 112 and the trigger housing 23 are made of the same material, in particular a fiber-reinforced plastic.

Figure 19A:
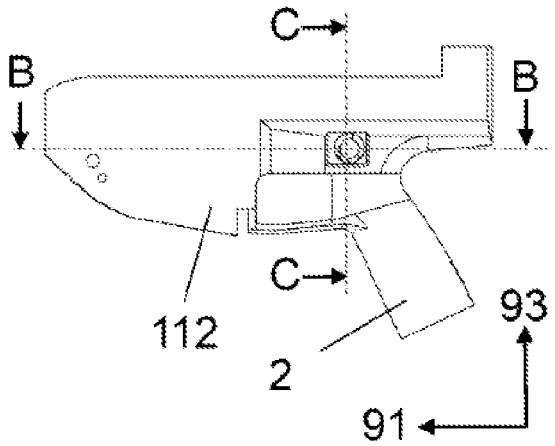
FIGS. 19A-19D show plan and detailed views of the trigger housing in the installed condition in a firearm's lower receiver.
Figure 19B:
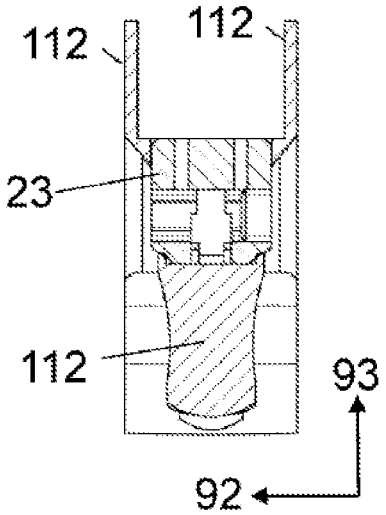
Figure 19C:
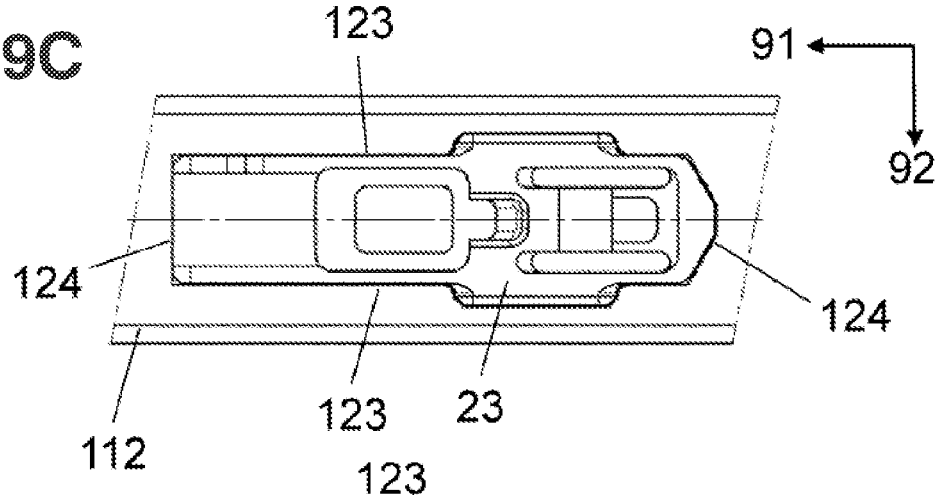
Figure 19D:
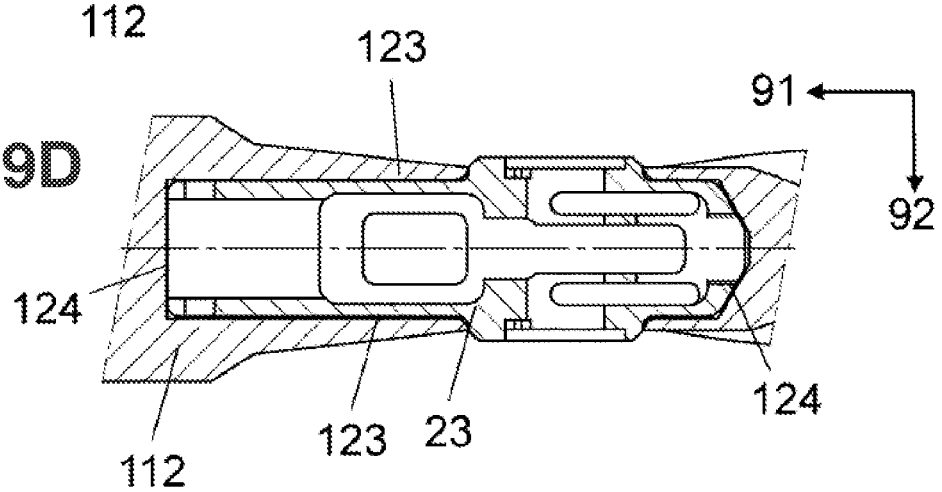

FIG. 19A shows a lower receiver 112 in a side view with the sectional plane B-B. FIG. 19B shows a plan view of the lower receiver 112 with the modular drop-in trigger unit 20, wherein the trigger housing 23 is shown for better visibility. FIG. 19*c* shows the section along the sectional plane B-B illustrated in FIG. 19A, and FIG. 19D shows a section along the sectional plane C-C.

As can be seen in a synopsis of FIGS. 19A-19C, the trigger pocket 12 can have lateral guides 123 and front and rear boundaries 124 (cf. FIG. 18) and is designed in a shape complementary to the trigger unit 20. The lateral guides 123 as well as the front and rear boundaries 124 can be designed, for example, as surfaces, ribs, nipples, rails, notches, etc. and accordingly have, for example, a flat, linear or punctiform optic and haptic effect. The modular drop-in trigger unit 20 has a corresponding outer contour that is complementary in shape.

In the assembled state, the sides of the trigger unit 20 (or of the trigger housing 23) are guided by the lateral guides 123 of the trigger pocket 12 and held in position. The front and rear ends of the trigger unit 20 (or the trigger housing 23) can rest against the front and/or rear boundaries 124 and thus guided into the trigger pocket 12 and held in position. Furthermore, at least one trigger housing protrusion 231 (FIGS. 12C and 12D) can be formed on the trigger housing 23 and can be received in a form-complementary trigger window 121, which is formed on the trigger pocket 12 in the lower receiver 112, so that the receiving surface 122 of the lower receiver 112 is the protrusion side surface 232 (FIG. 12C and 12D) of the trigger unit 20 (of the trigger housing 23) and therefore guides and holds it in position. The receiving surface 122 and the protrusion side surface 232 lie close to one another and at least substantially seal the interior of the housing against external environmental influences.

The trigger housing protrusion 231 (FIG. 12C) can, as shown, be designed on both sides and, as in the embodiment shown, be rectangular, but other shapes such as a V-shape, U shape, etc. are also possible.

The modular drop-in trigger unit 20 inserted in the trigger pocket 12 of the lower receiver 112 is thus positioned in the lower receiver 112 so that it cannot move in all directions except upward, and is also secured against upward movement in the installed condition by a retaining element in either the upper receiver 111 or the breech, and is thus fixed and immobile in the firearm's receiver 11.

The modular structure allows the number of fire positions to be changed by, for example, exchanging the fire-control/safety selector 60. Furthermore, the modular structure is advantageous, since by changing the trigger unit 20 it is possible to switch from a two-stage to a three-stage (pull-through) trigger quickly and without tools (and vice versa). There are also advantages in production because the modular drop-in trigger unit 20 according to the present disclosure can be produced particularly efficiently due to a generally small number of parts, and the individual variants of the trigger can also be implemented by exchanging only a very limited number of parts. For example, it is conceivable to use a trigger lever 26 with a trigger rear 263 designed to accommodate the back end 33 and/or a disconnector 30 with a back end 33 (which then has no function) in a pull-through trigger. Likewise, in a two-stage trigger, both a (again functionless) limiter 660 and a sear 40 that is designed to interact with a rocker lever 45 (not necessary in the two-stage trigger) are conceivable. It is also possible to have the same shape of the locking lever 620 (with or without a spring-loaded plunger 670) for either a rotary selector 610 or a sliding selector 650.

This modular drop-in trigger unit 20 according to the present disclosure can be exchanged without tools and therefore quickly and easily. If necessary, this modular drop-in trigger unit 20 represents an invention of its own, for example as defined below:

The present disclosure relates to a trigger unit (20) for a firearm and is characterized in that it is designed as a drop-in trigger unit (20) to complement a trigger pocket (12) of a lower receiver (112) of the firearm, and that the trigger pocket (12) accommodates the trigger housing (23), preferably completely accommodates it.

It should also be noted that the trigger pocket (12) as a reference value for the "module," the drop-in trigger unit (20) is necessary in the definition without actually being part of the subject matter according to the present disclosure. The term "accommodate" is understood here to mean that the trigger unit (20) is inserted (pushed) into the trigger pocket (12) in such a way that it only protrudes from the lower receiver (112) of the firearm with those parts for which the function of such a protrusion is necessary, and the term "fully" is intended to emphasize this; it is always a technical and not a mathematical-geometric approach.

In one embodiment it is provided that the trigger unit (20) has a hammer (21) which is rotatably mounted about a hammer axis (212) and can be biased by means of a hammer spring (211), wherein the hammer spring (211) has a first arm (2111) and a second arm (2112), a trigger lever (26) rotatably mounted about a trigger axis (262) which, preferably formed integrally with it, has a trigger bar (264) which, viewed in a normal direction (93), lies below the trigger axis (262) and is moved against a barrel direction (91) when the trigger bar (264) is actuated, wherein the trigger lever (26) has a trigger rear (263) that is designed to accommodate at least one disconnector (30), as well as a sear (40) rotatably mounted about a sear axis (43) and biased by means of a sear spring (41), wherein the hammer axis (212), the trigger axis (262) and the sear axis (43) are arranged parallel to one another and parallel to a transverse direction (92)

In another embodiment it is provided that the trigger housing (23) is formed with receptacles or bearings for the pins, shafts etc. (219, 269, 640) of the components (21, 26, 30, 40) rotatable about the axes (212, 35, 262, 43).

In yet another embodiment it is provided that laterally at least one trigger housing protrusion (231) is formed on the trigger housing (23) in the transverse direction (92).

The present disclosure also relates to a trigger pocket (12) of a firearm, in particular in its lower receiver 112, for a modular drop-in trigger unit (20) as defined above, wherein it is provided that the trigger pocket (12) has lateral guides (123) which support the trigger housing (23) and hold it in position.

In a further development the lateral guides (123) are designed as rails, nipples, or, preferably, flat.

In another development, the trigger pocket (12) has front and/or rear boundaries (124) that guide the trigger housing (23) and hold it in position.

In a further development the front and/or rear boundaries (124) are designed as a rail, nipple, or, preferably, flat.

In one embodiment of the last two developments it is provided that the trigger pocket (12) has a trigger window (121) with receiving surfaces (122) for receiving a trigger housing protrusion (231) with protrusion side surfaces (232), and a. that the receiving surfaces (122) are designed to complement the protrusion side surfaces (232),
b. that the receiving surfaces (122) guides the protrusion side surfaces (232) and hold the trigger housing (23) in position, and
c. that in the installed condition the receiving surfaces (122) and the protrusion side surfaces (232) lie against one another and thus seal the interior of the lower part of the receiver (11) from external environmental influences.

This aspect of the present disclosure also relates to a firearm with a breech, an upper receiver (111) and a lower receiver (112) with a trigger pocket (12) according to one of the preceding definitions, wherein a modular drop-in trigger unit (20) is secured against upward movement in the installed condition by the upper receiver (111) and/or the breech.

In the modular drop-in trigger unit (20) according to the present disclosure, a trigger other than the one shown and described, including one already known from the prior art, can be provided because the mentioned advantages of such a drop-in trigger unit (20) can also be used with other triggers.

Closing Remarks

The present disclosure is not limited to the illustrated and described exemplary embodiments, but can be modified and configured in various ways. In particular, the cross-sectional shapes shown in the illustrations of the mentioned receiver parts, pins, rails, recesses, etc. can be adapted to the given basic data, and the lengths and the positions with respect to the receiver can also be easily adapted by a person skilled in the art with knowledge of the present disclosure. In particular, equivalent designs are obvious with knowledge of the present disclosure and can be carried out without further ado by a person skilled in the art.

It should also be noted that, in the description and the claims, terms such as the "lower region" of an object, refer to the lower half and in particular the lower quarter of the overall height; "lowermost region" refers to the lowermost quarter, and in particular an even smaller part, while "central region" refers to the central third of the overall height. The use of the terms "width" or "length" apply mutatis mutandis. All of these terms have their generally accepted meanings applied to the intended position of the object under consideration.

Principally, it has to be stated that, the number and possibilities of combinations of the individual embodiments described are not limited to the variants shown and described. Further, it is no problem for the person skilled in the art and knowing the present disclosure to combine a detail of a first variant with one or more details of another variant or variants without sticking to (the) other details of the first variant! Free combinations of all details per se are possible without being mentioned here.

In the description and the claims, the term "substantially" means a deviation of up to 10% of the stated value, if physically possible, both downward and upward, otherwise only in the appropriate direction; in the case of degrees (angle and temperature), and for indications such as "parallel" or "normal," these terms mean±10°. If there are terms such as "substantially constant," etc., what is meant is the technical possibility of deviation which the person skilled in the art takes as a basis and not a mathematical deviation. For example, a "substantially L-shaped cross-section" comprises two elongated surfaces, which merge at one end into the end of the other surface, and whose longitudinal extension is arranged at an angle of 45° to 120° to one another.

All given quantities and percentages, in particular those relating to the limitation of the present disclosure, insofar as they do not relate to specific examples, are understood to have a tolerance of ±10%; accordingly, for example: 11% A means: from 9.9% to 12.1%. With terms such as "a holding means," the word "a" is not to be considered to represent a singular numeral ("one"), but rather is to be considered an indefinite article or pronoun, unless the context indicates otherwise.

The terms "combination" or "combinations" mean, unless otherwise stated, all types of combinations, starting from two of the relevant components up to a plurality or all of such components. The term "containing" also means "consisting of."

The features and variants stated in the individual embodiments and examples can easily be combined with those of the other examples and embodiments and, in particular, can be used for characterizing the invention in the claims without necessarily including the other details of the particular embodiment or of the particular example.

LIST OF REFERENCE SYMBOLS

| | | | |
|---|---|---|---|
| 1 | Barrel | 40 | Sear |
| 2 | Grip | 41 | Sear spring |
| 3 | Magazine | 412 | Sear spring supports |
| 4 | Stock | 42 | Bearing |
| 7 | Handguard | 43 | Sear axis |
| 5 | Bore axis | 44 | Sear edge |
| 6 | Firearm median plane | 45 | Rocker lever |
| 11 | Receiver | 451 | First end |
| 111 | Upper receiver | 452 | Second end |
| 112 | Lower receiver | 455 | Dowel pin |
| 12 | Trigger pocket | 456 | Rocker axis |
| 121 | Trigger window | 46 | Spring recess |
| 122 | Receiving surfaces | 461 | Ramp |
| 123 | Lateral guides | 465 | Sear bottom |
| 124 | Front and rear boundaries | 47 | Sear opening |
| 20 | Trigger unit | 48 | Front end |
| 21 | Hammer | 50 | Auto sear |
| 211 | Hammer spring | 51 | Auto sear edge |
| 2111 | First arm | 52 | Auto sear axis |
| 2112 | Second arm | 53 | Top |
| 212 | Hammer axis | 54 | Leg |
| 213 | Hammer hook | 55 | Spring seat |
| 214 | Auto sear hook | 56 | Auto sear pin |
| 215 | Hammer cam | 57 | Hammer stop |
| 216 | Safety cam | 60 | Fire-control/safety selector |
| 217 | Hammer recess | 610 | Rotary selector |
| 219 | Hammer pin | 6101 | Actuators |
| 23 | Trigger housing | 6102 | Sealing plates |
| 231 | Trigger housing protrusion | 611 | First rotary lever |
| 232 | Protrusion side surfaces | 6111 | Cylinder |
| 236 | Locking lever recess | 6112 | End section |
| 237 | Selector hole | 6212 | Hollow cylinder |
| 238 | Selector cam | 6213 | Hollow cylinder axis |
| 239 | Indicator | 612 | Second rotary lever |
| 26 | Trigger lever | 613 | Stud |
| 261 | Hammer spring support | 614 | Rib |
| 262 | Trigger axis | 615 | Continuous notch |
| 263 | Trigger rear | 616 | Detent |
| 264 | Trigger bar | 6165 | Selector slot |
| 265 | Contact surface | 617 | Cam surface |
| 266 | Spur | 618 | Stop nipple |
| 269 | Trigger pin | 619 | Indicator window |
| 270 | Gap | 620 | Locking lever |
| 30 | Disconnector | 621 | Locking lever arm |
| 31 | Disconnector hook | 622 | Spike |
| 32 | Disconnector joint | 625 | Locking lever body |
| 33 | Back end | 630 | Locking lever spring |
| 34 | Disconnector spring | 640 | Locking lever pin |
| 35 | Disconnector axis | 641 | Locking lever axis |
| 36 | Finger | 650 | Sliding selector |
| 654 | Top | 651 | Recess |
| 655 | Push portion | 652 | Grooves |
| 660 | Limiter | 653 | Stop |
| 661 | Projection | 70 | Rest position |
| 664 | Counter surface | 71 | $1^{st}$ trigger stage position |
| 670 | Spring loaded plunger | 72 | $2^{nd}$ trigger stage position |
| | | 73 | $3^{rd}$ trigger stage position |
| | | 91 | Barrel direction (front) |
| | | 92 | Transverse direction (left) |
| | | 93 | Normal direction (up) |
| | | 94 | Hammer rotating direction |

The invention claimed is:

1. A trigger unit for a firearm, comprising:

a hammer that is rotatably mounted about a hammer axis, the hammer being biased by a hammer spring having a first arm and a second arm;

at least one disconnector;

a trigger lever including a trigger bar and a trigger rear, where the trigger lever is rotatably mounted about a trigger axis; where the trigger bar, when viewed in a normal direction, lies below the trigger axis, the trigger bar being actuated by a movement against a barrel direction; and the trigger rear being configured to accommodate the at least one disconnector;

a sear rotatably mounted about a sear axis, the sear being biased by a sear spring, where the sear is at least partially arranged in a recess defined by the trigger lever and has a bearing on an upper side for receiving a disconnector joint formed on an underside of the at least one disconnector, where the bearing at least partially encloses the disconnector joint in a direction of rotation about a disconnector axis, and limits rotation of the disconnector joint about the disconnector axis;

wherein the hammer axis, the trigger axis and the sear axis are arranged parallel to one another and parallel to a transverse direction; and the sear axis and the trigger axis coincide.

2. The trigger unit of claim 1, wherein the trigger bar is formed integrally with the trigger lever.

3. The trigger unit of claim 1, further comprising:

a fire-control/safety selector that is held in a selectable position by a locking lever, where the locking lever includes a locking lever body that is biased by a locking lever spring; and a limiter arranged in the trigger unit between the locking lever and the locking lever spring so that the limiter is rotatably mounted about a locking lever axis parallel to the transverse direction, and is also biased by the locking lever spring, so that the limiter limits a rotational movement of the locking lever around the locking lever axis.

4. The trigger unit of claim 1, further comprising a rocker lever having a first end and a second end, where the rocker lever is rotatably mounted around a rocker axis that, when considered in the barrel direction, is disposed in front of the trigger axis;

where the trigger lever has a rest position and three trigger stage positions, such that when the trigger lever is in the third trigger stage position:

the first end of the rocker lever is pressed downward by the sear, as viewed in the normal direction, and the rocker lever is thereby rotated about the rocker axis; and the second end of the rocker lever protrudes upward, as viewed in the normal direction, and moves a finger of the at least one disconnector upward and around the disconnector axis.

5. The trigger unit of claim 4, wherein the sear defines a sear opening for the second end of the rocker lever to extend through, where the sear opening is disposed in front of the disconnector axis, when viewed in the barrel direction.

6. The trigger unit of claim 1, further comprising an auto sear rotatably mounted about an auto sear axis and biased by the hammer spring, where the auto sear axis is disposed in front of the hammer axis, when viewed in the barrel direction.

7. The trigger unit of claim 6, further comprising a spring seat for supporting the second arm of the hammer spring, wherein the spring seat is formed on the auto sear below the auto sear axis, when viewed in the normal direction.

8. The trigger unit of claim 7, wherein the hammer spring is attached via the first arm of the hammer spring to a hammer spring support formed on the trigger lever, and is attached via the second arm of the hammer spring to the spring seat of the auto sear.

9. The trigger unit of claim 1, further comprising a hammer spring support for supporting the hammer spring formed on the trigger lever, when viewed in the transverse direction.

10. The trigger unit of claim 1, further comprising a disconnector spring for biasing the at least one disconnector about the disconnector axis, wherein the at least one disconnector defines a recess on the underside thereof, when viewed in the normal direction, where the recess is capable of at least partially accommodating the disconnector spring.

11. The trigger unit of claim 1, further comprising a disconnector spring for biasing the at least one disconnector about the disconnector axis, wherein the sear defines a spring recess on a side facing the at least one disconnector capable of at least partially accommodating the disconnector spring.

12. The trigger unit of claim 11, wherein the spring recess is at least partially open when viewed laterally in the transverse direction.

13. The trigger unit of claim 12, wherein the spring recess includes an outwardly sloping ramp, when viewed in the transverse direction.

14. The trigger unit of claim 1, wherein the trigger lever has at least a rest position and a first trigger stage position, further comprising at least one spur formed on the trigger lever and extending forward from the trigger axis in the barrel direction, and a safety cam formed on the hammer in an area of the hammer axis, such that the at least one spur protrudes into a movement path of the safety cam of the hammer when the trigger lever is in either the rest position or the first trigger stage position.

15. The trigger unit of claim 1, further comprising a rotary fire-control/safety selector that is rotatably mounted about an axis parallel to the transverse direction, wherein the trigger lever has a rest position and three trigger stage positions, further comprising a back end formed on the at least one disconnector such that when the trigger lever is in the second trigger stage position a stud of the rotary fire-control/safety selector is pressed downward on the back end of the at least one disconnector against the force of a disconnector spring for biasing the at least one disconnector about the disconnector axis.

16. The trigger unit of claim 1, wherein the trigger unit is accommodated in a trigger housing.

17. The trigger unit of claim 16, wherein the trigger unit is configured as a modular drop-in trigger unit.

18. A firearm, comprising:

a trigger unit including at least one disconnector;

a hammer that is rotatably mounted about a hammer axis, the hammer being biased by a hammer spring having a first arm and a second arm;

a trigger lever including a trigger bar and a trigger rear, where the trigger lever is rotatably mounted about a trigger axis; where the trigger bar, when viewed in a normal direction, lies below the trigger axis, the trigger bar being actuated by a movement against a barrel direction; and the trigger rear being configured to accommodate the at least one disconnector;

a sear rotatably mounted about a sear axis, the sear being biased by a sear spring, where the sear is at least partially arranged in a recess defined by the trigger lever and has a bearing on an upper side for receiving a disconnector joint formed on an underside of the at least one disconnector, where the bearing at least partially encloses the disconnector joint in a direction of rotation about a disconnector axis, and limits rotation of the disconnector joint about the disconnector axis;

wherein the hammer axis, the trigger axis and the sear axis are arranged parallel to one another and parallel to a transverse direction; and the sear axis and the trigger axis coincide.

* * * * *